US011508347B1

(12) United States Patent
Johnson

(10) Patent No.: US 11,508,347 B1
(45) Date of Patent: Nov. 22, 2022

(54) PORTABLE ACOUSTICAL ROAD BARRIER

(71) Applicant: L.J. Avalon, LLC., Tampa, FL (US)

(72) Inventor: Lahnie Johnson, Tampa, FL (US)

(73) Assignee: L.J. Avalon, LLC, Tampa, FL (US)

( * ) Notice: Subject to any disclaimer, the term of this patent is extended or adjusted under 35 U.S.C. 154(b) by 388 days.

(21) Appl. No.: 16/712,366

(22) Filed: Dec. 12, 2019

Related U.S. Application Data

(63) Continuation-in-part of application No. 15/620,944, filed on Jun. 13, 2017, now Pat. No. 10,526,782, and a continuation-in-part of application No. 15/338,240, filed on Oct. 28, 2016, now Pat. No. 10,482,864.

(60) Provisional application No. 62/351,221, filed on Jun. 16, 2016, provisional application No. 62/248,894, filed on Oct. 30, 2015.

(51) Int. Cl.
*G10K 11/162* (2006.01)
*E01F 15/00* (2006.01)

(52) U.S. Cl.
CPC ..... *G10K 11/162* (2013.01); *E01F 15/006* (2013.01)

(58) Field of Classification Search
CPC ..... G10K 11/162; E01F 15/006
USPC ..... 181/287
See application file for complete search history.

(56) References Cited

U.S. PATENT DOCUMENTS 4,175,639 A * 11/1979 Wirt ..... E01F 8/0047 181/295
4,193,474 A * 3/1980 Okubo ..... E04B 1/8227 181/290
4,834,213 A * 5/1989 Yamamoto ..... E01D 19/06 181/290
4,899,498 A * 2/1990 Grieb ..... E01F 8/0017 52/145
5,272,284 A * 12/1993 Schmanski ..... E01F 8/0023 181/290
6,016,887 A * 1/2000 Underhill ..... E01F 15/083 181/210
D701,107 S * 3/2014 White ..... D8/354
9,897,123 B2 * 2/2018 Esposito ..... E01F 15/088
2009/0178882 A1 * 7/2009 Johnson ..... E04B 9/0428 181/290
2015/0224738 A1 * 8/2015 Gallagher ..... B29C 66/72343 428/221

* cited by examiner

*Primary Examiner* — Forrest M Phillips
(74) *Attorney, Agent, or Firm* — Frijouf, Rust & Pyle P.A.

(57) ABSTRACT

A portable acoustic road barrier for use with a road divider is disclosed comprising a frame having a lower horizontal panel frame portion, a first and a second vertical panel frame portion and an upper horizontal panel frame portion. A first and a second mount from the frame for removably securing the frame to the road divider. A sheet of acoustical blocking material is secured to the panel frame portions. The sheet of acoustical blocking material is flexible for enabling the sheet of acoustical blocking material and reinforcing tape to be rolled as a single unit for transportation.

13 Claims, 21 Drawing Sheets

*-14dB @ 40-50Hz = >60% noise reduction to the human ear
*-8.5dB @ 60Hz = aprox 45% noise reduction to the human ear

SAA = 0.07
NRC = 0.05

PORTABLE ACOUSTICAL ROAD BARRIER

CROSS-REFERENCE TO RELATED APPLICATIONS

This is a continuation-in-part of application Ser. No. 15/338,240 filed Oct. 28, 2016. Application Ser. No. 15/338,240 filed Oct. 28, 2016 claims benefit of U.S. Patent Provisional application No. 62/248,894 filed Oct. 30, 2015.

This application claims benefit of U.S. patent application Ser. No. 15/620,944 filed Jun. 13, 2017. U.S. patent application Ser. No. 15/620,944 filed Jun. 13, 2017 claims benefit of U.S. Patent Provisional application No. 62/351,221 filed Jun. 16, 2016.

All subject matter set forth in U.S. patent application Ser. No. 15/338,240 filed Oct. 28, 2016 and U.S. Patent Provisional application No. 62/248,894 filed Oct. 30, 2015 and U.S. patent application Ser. No. 15/620,944 filed Jun. 13, 2017 and U.S. Patent Provisional application No. 62/351,221 filed Jun. 16, 2016 is hereby incorporated by reference into the present application as if fully set forth herein.

BACKGROUND OF THE INVENTION

Field of the Invention

This invention relates to sound control and more particularly to an improved flexible acoustical blocking material suitable for outdoor use.

Background of the Invention

The prior art has known various types of devices and methods for reducing the level of sound within an environment. The various types of devices and methods of the prior art for reducing the level of sound within an environment included a diverse and variety of apparatuses and methods adapted for many as specific applications and uses.

One particular type of device for reducing the level of sound within an environment comprises the use of sound reducing panels and/or sound absorbing devices. Various types of sound reducing panels and sound absorbing devices have been incorporated by the prior art to reduce the level of sound and/or to selectively reduce or inhibit reflection of sound from reflective surfaces within an environment.

In some instances, the apparatuses and methods for reducing the level of sound within an environment selectively reduced the level of sound within an environment. Many of the apparatuses and methods for reducing the level of sound within an environment were specifically designed for providing enhancements for improving the acoustics within the environment. Sound reducing panels and sound absorbing devices have been employed in very large rooms such as auditoriums as well as smaller rooms such as recording studios, home theaters and the like.

Other apparatuses and methods for reducing the level of sound within an environment of the prior art reduce the overall level of acoustic noise and/or sound and/or noise within the environment. In many cases, sound absorbing apparatuses and methods were used to reduce the sound of operating machinery as well as being used for reducing the transmission of sound and/or noise between the adjacent walls of a building.

The following U.S. Patents are representative of the attempts of the prior art to provide apparatuses and devices for reducing sound within an environment.

U.S. Pat. No. 2,495,636 to O. R. Hoeltzel et al. discloses a unit comprising a layer of loosely matted mass of fibrous material. A substantially impervious preformed and film of thermoplastic synthetic resin material is integralized with the fibers in one face of the loosely matted material. A fabric covering on the other face of the loosely matted layer is enfolded and is secured about the edges of the mass and the film. The mass, film and fabric are in the form of the sound proof flexible panel adapted to cover and soundproof a section of a wall.

U.S. Pat. No. 2,497,912 to W. M. Rees discloses an acoustic construction for the walls and ceilings of an enclosure comprising a sound absorbing layer overlying the wall and formed by a plurality of rectangles or tiles of fibrous material arranged in a plane. The edge of each of the tiles is contiguous to and slightly spaced from the edges of adjoining tiles. A renewable facing for the sound absorbing layer includes a plurality of thin sheets of porous material individual to the tiles. Each of the sheets having tabs at its edges integral with the sheets and resiliently held in place between adjacent edges of the tiles to hold the sheets in place over the face of the tiles.

U.S. Pat. No. 2,553,363 to C. C. Droeger discloses a non-combustible wall or ceiling of a plurality of parallel, latterly spaced, non-combustible primary furrings anchored thereon. Sound absorbent pads are arranged between adjacent pairs of furrings. A plurality of spaced, non-combustible secondary furring extend extended transversely across the primary furrings and are secured thereto. Each of the secondary furrings comprise a portion lying in a plane parallel with the wall or ceiling and bridging between primary furrings and are provided with a multiplicity of perforations adapted to threadably receive threaded shanks of screws. A multi-perforate finish sheaths overlies the aforesaid parts.

U.S. Pat. No. 2,694,025 to G. Slayter et al. discloses a structural board comprising a core of glass fibers bounded into a porous self-sufficient layer. A layer of substantially inorganic cementitious material is integrated with at least one of the faces of the core. The cementitious layer is formed of a composition consisting essentially of an amide-aldehyde resin selected from the group consisting of urea formaldehyde and melamine formaldehyde and gypsum cement.

U.S. Pat. No. 2,923,372 to M. Maccaferri discloses an all plastic acoustic tile formed of a molded plastic material comprising a plate-like body having a rearwardly extending edge flange thereabout integral therewith. The body is formed to provide the front side thereof as a flat, planar face and having a multiplicity of apertures therethrough from the front face to and opening through the rear side all the body. Sound wave dampening tubes are molded integrally with the body projecting rearwardly from the rear side thereof. Each of the dampening tubes has a passage therethrough opening at the rear end thereof. Each of the dampening tubes is located on the rear side of the body in position with a body aperture opening into and forming the inlet to the passage of the dampening tube. The body has the rear side thereof formed with an annular recess therein about each of the dampening tubes providing a reduced thickness base portion of the body with which the tube is integrally joined.

U.S. Pat. No. 3,136,397 to O. C. Eckel discloses an assembly with two angular adjoining walls and a ceiling. The assembly comprises a plurality of panels with a first of the panels extending along the ceiling from the first wall. A second of the panels extends along the first wall below the ceiling panel. A Z-shaped retainer embodying one angular portion is attached to the first wall. Another angular portion extends laterally away from the wall indirectly below the first ceiling panel and above the second panel. And a third angular portion extends downwardly away from the ceiling panel. The ceiling first panel rests on the other angular portion of the retainer.

U.S. Pat. No. 3,949,827 to Witherspoon discloses an acoustical panel assembly having improved structural, decorative and acoustical properties. The panel assembly includes a perimeter frame. A thin septum member is supported in the center of the frame. A fibrous glass layer is positioned adjacent each side of the septum member. A molded, semi-rigid, fibrous glass diffuser member is positioned adjacent each of the fibrous glass layers. The assembly includes means for joining adjacent panel assemblies and, in one embodiment, an outer decorative fabric layer is positioned adjacent each of the outer surfaces of the diffuser members.

U.S. Pat. No. 3,967,693 to Okawa discloses a means and method for diminishing energy of sound. A corrugated cover having holes therethrough is mounted on a wall by ribs and an edge plate. The wall and edge plate together with the ribs and corrugated cover form a plurality of chambers, each cooperating with a plurality of the holes for diminishing the energy of impinging sound waves.

U.S. Pat. No. 4,113,053 to Matsumoto et al. discloses a sound absorbing body which can effectively be utilized as an exterior sound absorbing wall or an interior wall of a house. The sound absorbing body comprises a number of sound absorbing cavities inclined at an angle alpha which is smaller than 80 degrees with respect to a transverse horizontal sectional plane of the body. The sound absorbing cavities being opened at the sound incident surface.

U.S. Pat. No. 4,160,491 to Matsumoto et al. discloses a perlite sound absorbing plate and a sound insulating wall constructed by arranging a number of the plates side by side and by assembling together into one integral body. The plate is composed of a mixture including 1,000 cubic centimeters by bulk volume of formed perlite particles each having a diameter of 0.1 to 7.0 millimeters 100 to 140 grams of cement, liquid rubber latex containing 5 to 20 grams of solid ingredients and a suitable amount of water and produced by press molding with a compression ratio of 1.10 to 1.30. The wall is constructed by assembling a number of the plates each provided with a side groove with the aid of supporting columns and reinforcing plates, each having a ridge adapted to be engaged with the side groove of the plate.

U.S. Pat. No. 4,207,964 to Taguchi discloses a sound absorbing and diffusing unit provided for assembling an acoustic screen which can be placed or hung in front of a wall inside an acoustic room for improving a sound-effect therein. These units are detachably joined together with each other so that they may be easily separated and assembled again to form an acoustic screen having another shape or construction to adjust or modulate a sound-effect. A sound absorbing porous panel having a desired picture or pattern can be easily hung against a wall. The decorative panel can be reversely hung on the wall to provide another interior ornamentation. Accordingly, an acoustically correct room and a desired ornamentation on a wall inside the acoustic room can be easily obtained and changed without providing a rigid reverberating surface of the room.

U.S. Pat. No. 4,248,325 to Georgopoulos discloses an improved sound absorptive tackable space dividing wall panel or similar article in which a wire mesh screen is disposed within the sound absorptive material a distance from the tackable surface less than the length of the tack pin, thereby providing additional support for the tackable load without appreciably reducing the sound absorptive characteristics of the panel.

U.S. Pat. No. 4,306,631 to Reusser discloses a noise barrier or other type wall or building assembly including a plurality of spans each extending between spaced apart posts and having top and bottom girts affixed to the posts and in turn supporting a plurality or series of vertically disposed panels. Unique mating interlock elements integrally formed along both lateral edges of the wall or building exterior panels allow the sequential interconnection of all panels in a series by means of a rotating displacement of the individual panels to yield multilateral interlocking of the panels. The panel faces are configured to provide shadow texture, while masking of the posts and top girts in a free-standing type wall is obtained by a split cover assembly and split cap trim, respectively.

U.S. Pat. No. 4,402,384 to Smith et al. discloses a sound barrier system particularly suited for out-of-doors, ground-mounted installations, such as for a highway noise barrier comprising a vertical wall composed of successive individual wall sections arranged with immediately adjacent wall sections disposed at an intersecting angle to each other. Immediately adjacent wall sections are rigidly joined together in abutment along a common vertical joint. An earth anchor is anchored into the ground at each vertical joint. Each joint is secured to the corresponding earth anchor so that downwardly directed hold-down forces are applied by the earth anchors to the wall at the bottom portions of the joints.

U.S. Pat. No. 4,605,090 to Melfi discloses a post and panel type noise barrier fence formed of a plurality of concrete vertical posts or columns which have grooves to hold flat concrete panels between successive ones of the columns. The panels can have a stepped lower edge to accommodate elevational changes in the terrain. Also, certain of the columns have oppositely disposed recesses angled from each other so as to accommodate directional changes at the columns in the direction of the barrier fence.

U.S. Pat. No. 4,607,466 to Allred discloses an acoustic panel having a porous layer and a generally rigid layer affixed to each other. The generally rigid layer includes at least one passageway opening on one side of the rigid layer and extending through the rigid layer to the porous layer. The porous layer is a fibrous material. The rigid layer is a concrete-type material, such as vermiculite-cement plaster. This acoustic panel further comprises a generally rigid planar surface positioned adjacent to the porous layer. This generally rigid planar surface can comprise an insulating layer affixed to the other side of the porous layer and a structural layer fastened to the insulating layer. The insulating layer is a polyurethane foam board. The structural layer is a particle board.

U.S. Pat. No. 4,805,734 to Mast discloses an acoustic wall for streets and parks and for garden-like designs consisting of several substantially U-shaped frame members arranged at a distance from one another, which frame members are connected among one another and have mats applied on their front and side surfaces. In order to substantially reduce the manufacture on location, the duration of setting up and the greening time on location, the acoustic wall consists of individual elements of which each has several U-shaped frame members which are secured at the ends of their long legs on a base. The base forms a rigid frame with fastening means for a lift for the lifting and transporting of the acoustic wall. One or several narrow-mesh mats are secured on the base, which mats prevent a falling out of material filled into the acoustic wall during transport.

U.S. Pat. No. 4,834,213 to Yamamoto et al. discloses a noise silencer for highways adapted to be stuffed in a joint gap formed in a highway. It has a rectangular casing and padding enclosed in the casing. The casing is provided with a vent hole adapted to be closed by a plug. Before mounting the noise silencer, air is firstly sucked out from the silencer through the vent hole to flatten the padding and the vent hole is plugged. After the silencer has been mounted, the vent hole is open to inflate the padding so that the silencer will be pressed against the opposite walls of the joint gap.

U.S. Pat. No. 5,217,771 to Schmanski et al. discloses a device for preventing the transmission of sound, the device being fabricated of polymer composition and comprising a hollow core member formed of fiber-reinforced thermosetting resin, and at least an outer member formed of unreinforced thermoplastic resin which is friction fit to the core member. The core member and outer members are preferably formed by pultrusion and extrusion, respectively. Adjacently disposed devices are connected together to form a fence-like barrier through which few or no sound waves are allowed to pass. This system is advantageously used to prevent sound waves emanating from a large transportation structure such as a highway, railroad track, or airport.

U.S. Pat. No. 5,272,284 to Schmanski discloses a sound wall for placement along a roadside for reducing the transmission of sound from a traffic area wherein the sound wall comprises a plurality of stiff, resilient containment members respectfully configured with the channel configuration and having an enclosed channel volume and continuous open side. Each channel volume is filled with a composite composition of rubber chips and binder compressed within the channel and substantially filling the channel volume. These containment members are stacked in nesting relationship to form a wall structure, with the open side being oriented toward the traffic area.

In my prior invention set forth in U.S. Pat. No. 7,063,184, I disclosed an apparatus and method of making an improved sound reducing panel suitable for use in an outdoor or a hazardous environment. The improved sound reducing panel comprises a water resistant sound absorbing member with a porous covering sheet overlaying a face surface of the sound absorbing member. A support frame is disposed about an outer perimeter of the sound absorbing member. An attachment secures the improved sound reducing panel to the support frame. In one embodiment, a sound blocking member is located adjacent to the sound absorbing member.

In another prior invention set forth in U.S. Pat. No. 7,503,428, I disclosed an apparatus and method for an improved acoustic panel comprising a sound absorbing member defined by a first and second face surface and a plurality of peripheral edges. A sound blocking member is defined by a first and second face surface and a plurality of peripheral edges. The first face surface of the sound blocking member is secured relative to the second face surface of the sound absorbing member for blocking the transmission of sound therethrough. In another embodiment, the first face surface of the sound blocking member is spaced relative to the second face surface of the sound absorbing member for decoupling the sound blocking member from the sound absorbing member.

In still further prior invention set forth in U.S. Pat. No. 8,739,924, I disclosed an apparatus and method for an improved acoustic panel comprising a sound absorbing member defined by a first and second face surface and a plurality of peripheral edges. A sound blocking member is defined by a first and second face surface and a plurality of peripheral edges The first face surface of the sound blocking member is secured relative to the second face surface of the sound absorbing member for blocking the transmission of sound therethrough. In another embodiment, the first face surface of the sound blocking member is spaced relative to the second face surface of the sound absorbing member for decoupling the sound blocking member from the sound absorbing member.

In my prior application Ser. No. 15/338,240 filed Oct. 28, 2016, I disclosed a novel portable acoustical blocking system capable of being readily installed on existing supports such a fences and the like.

In my prior invention set forth in U.S. patent application Ser. No. 16/033,774 filed Jul. 12, 2018 entitled Portable Decorative Acoustic Blocking System, I disclosed a decorative version of the portable acoustical blocking system set forth in U.S. patent application Ser. No. 15/338,240.

It is an object of the present invention to continue to improve upon my prior invention by providing a portable acoustical blocking system for installation on a barrier such as a road barrier and the like.

Another object of this invention is to provide a portable acoustical blocking system that is suitable for outdoor use.

Another object of this invention is to provide a portable acoustical blocking system that may be rolled for easy transportation and storage.

Another object of this invention is to provide a portable acoustical blocking system that may be use on a conventional ASTM C 825 and NCHRP 350 precast concrete barriers as well as other types, styles and materials of road and non-road barriers.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to a portable acoustic road barrier for use with a road divider. The portable acoustic road barrier comprises a frame having a lower horizontal panel frame portion extending between a first and a second end. A first and a second vertical panel frame portion is connected to the first and second ends of the lower horizontal panel frame portion. An upper horizontal panel frame portion extends between a first and a second end and supported by the first and second vertical panel frame portions. A first mount extends from the first end of the frame for removably securing the frame to the road divider. A second mount extends from the second end of the frame for removably securing the frame to the road divider. A sheet of acoustical blocking material has a first and a second side and bound by a material edge. The sheet of acoustical blocking material has a thickness of approximately one-eighth of an inch and a density of greater than one pound per square foot. A plurality of fasteners secures the flexible acoustical blocking material to the panel frame portions. The sheet of acoustical blocking material is flexible for enabling the sheet of acoustical blocking material and reinforcing tape to be rolled as a single unit for transportation.

In a more specific example of the invention, the first and second vertical panel frame portions are removably secured to the first and a second end of the frame. The upper horizontal panel frame portion is removably secured to the first and second end of the first and second vertical panel frame portions.

In one example, the first mount includes a first flange secured to the first end of the frame for fastening to a first portion of the road divider. The second mount includes a second flange secured to the second end of the frame for fastening to a second portion of the road divider. In another example, the first mount includes a first saddle secured to the first end of the frame for fastening to a first portion of the road divider. The second mount includes a second saddle secured to the second end of the frame for fastening to a second portion of the road divider. In still another example, the first mount includes the first vertical panel frame portions extending into a first aperture in the road divider. The second mount includes the second vertical panel frame portions extending into a second aperture in the road divider.

Preferably, the sheet of acoustical blocking material comprises a sheet of flexible barium free formulation mineral filled to have a weight greater than one pound per square foot. In another example, a reinforcing tape is secured to the acoustical blocking material. The reinforcing tape may comprise a woven polyester material heat welded to the acoustical blocking material.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
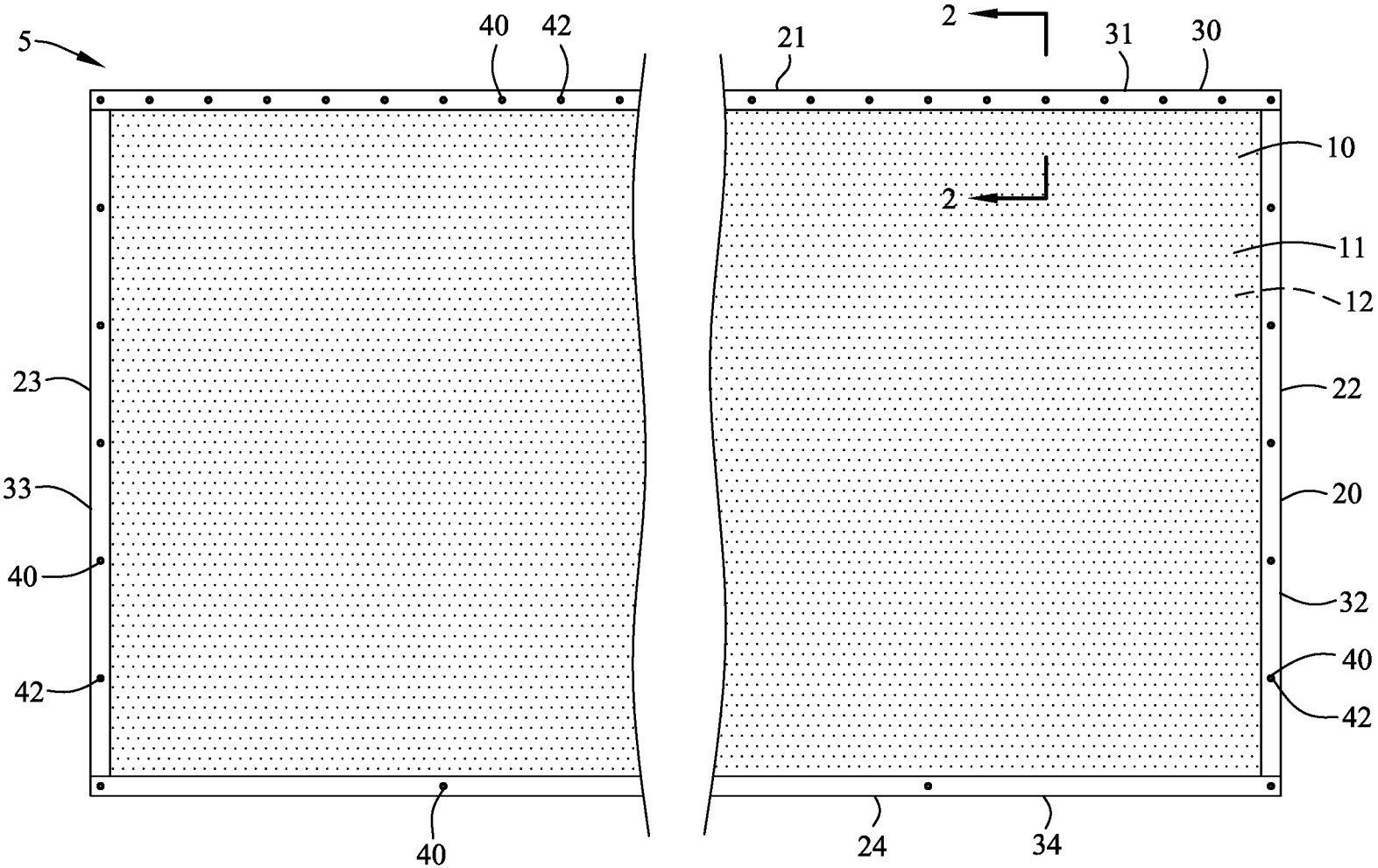
FIG. 1 is a front view of the portable acoustical blocking system of the present invention.
Figure 2:
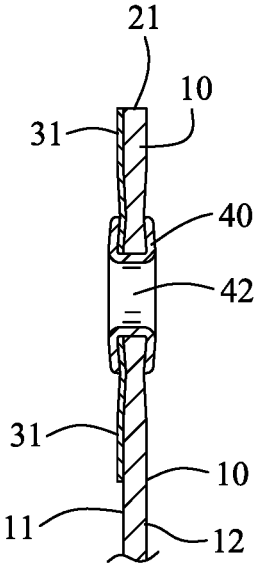
FIG. 2 is an enlarged sectional view along line 2-2 in FIG. 1.
Figure 3:
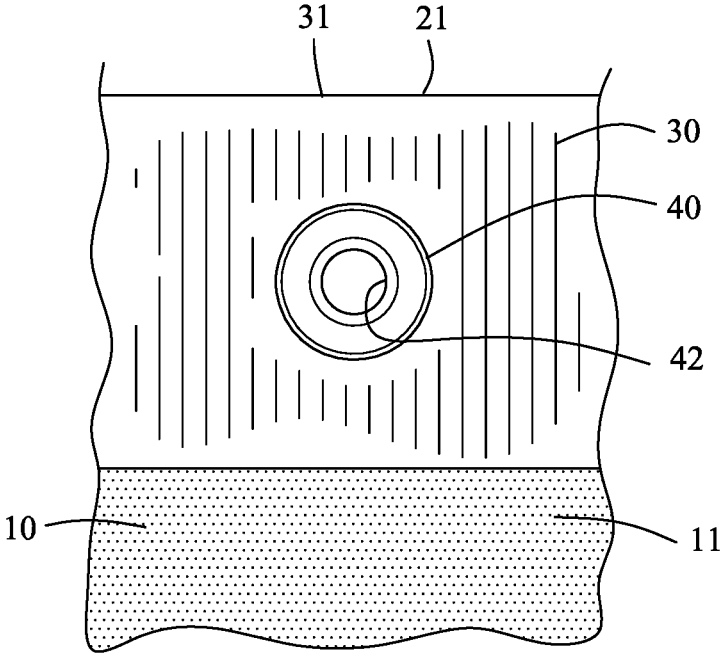
FIG. 3 is a magnified view along line 3-3 in FIG. 2.

FIGS. 1-3 are various views of the portable acoustical blocking system 5 of the present invention. The portable acoustical blocking system 5 comprises sheet of acoustical blocking material 10 having a first side surface 11 and a second side surface 12. The sheet of acoustical blocking material 10 is bound by a material edge 20. In this example, the sheet of acoustical blocking material 10 is bound by a top material edge 21, side material edges 22 and 23 and a bottom material edge 24. The material edges 21-24 define a perimeter of the sheet of acoustical blocking material 10. Although the parameter defined by the material edges 21-24 are shown as a rectangular configuration, it should be understood by those skilled in the art and that the sheet of acoustical blocking material 10 may take various configurations.

FIG. 2 is an enlarged sectional view along line 2-2 in FIG. 1. In this example, the sheet of acoustical blocking material 10 has a thickness of approximately one-eighth of an inch. The acoustical blocking material 10 comprise a heavy mineral filled, barium free visco elastic acoustical material having a density of greater than one pound per square foot. The sheet of acoustical blocking material 10 is flexible for enabling the sheet of acoustical blocking material 10 to be rolled for transportation and/storage.

An important aspect of the present invention is the addition of a reinforcing tape 30 affixed to the first side of the sheet of acoustical blocking material 10 adjacent to the material edge 20. In this example, reinforcing tapes 31-34 are affixed adjacent to the material edges 21-24 respectively. The reinforcing tape 30 is heat welded to the first side 11 of the sheet of acoustical blocking material 10. In the heat welding process, both the first side 11 of the sheet of acoustical blocking material 10 and the reinforcing tape 30 are simultaneously heated to an appropriate temperature. After the acoustical blocking material 10 and the reinforcing tape 30 are simultaneously are heated to the appropriated temperature, the reinforcing tape 30 is pressed upon the first side 11 of the sheet of acoustical blocking material 10. In one example, the reinforcing tape comprises a woven polyester material but it should be understood that various other materials may be used as a reinforcing tape 30.

Referring back to FIG. 1, a plurality of hangers 40 are secured to the sheet of acoustical blocking material 10. The plurality of hangers 40 enable the sheet of acoustical blocking material to be suspended from a support for inhibiting the flow of acoustic energy between the first side surface 11 and second side surface 12 of the acoustical blocking material 10.

FIG. 3 is a magnified view along line 3-3 in FIG. 2 further illustrating one of the plurality of hangers 40. Each of the plurality of hangers 40 extends through the reinforcing tape 30 and the sheet of acoustical blocking material 10. The reinforcing tape 30 provides structural strength to the plurality of hangers 40 for suspending the sheet of acoustical blocking material from a support.

In this example, the plurality of hangers 40 are shown as grommets having grommet apertures 42. Although the plurality of hangers 40 are shown as grommets having grommet apertures 42, it should be understood by those skilled in the art and that the plurality of hangers 40 may take various configurations.

Figure 4:
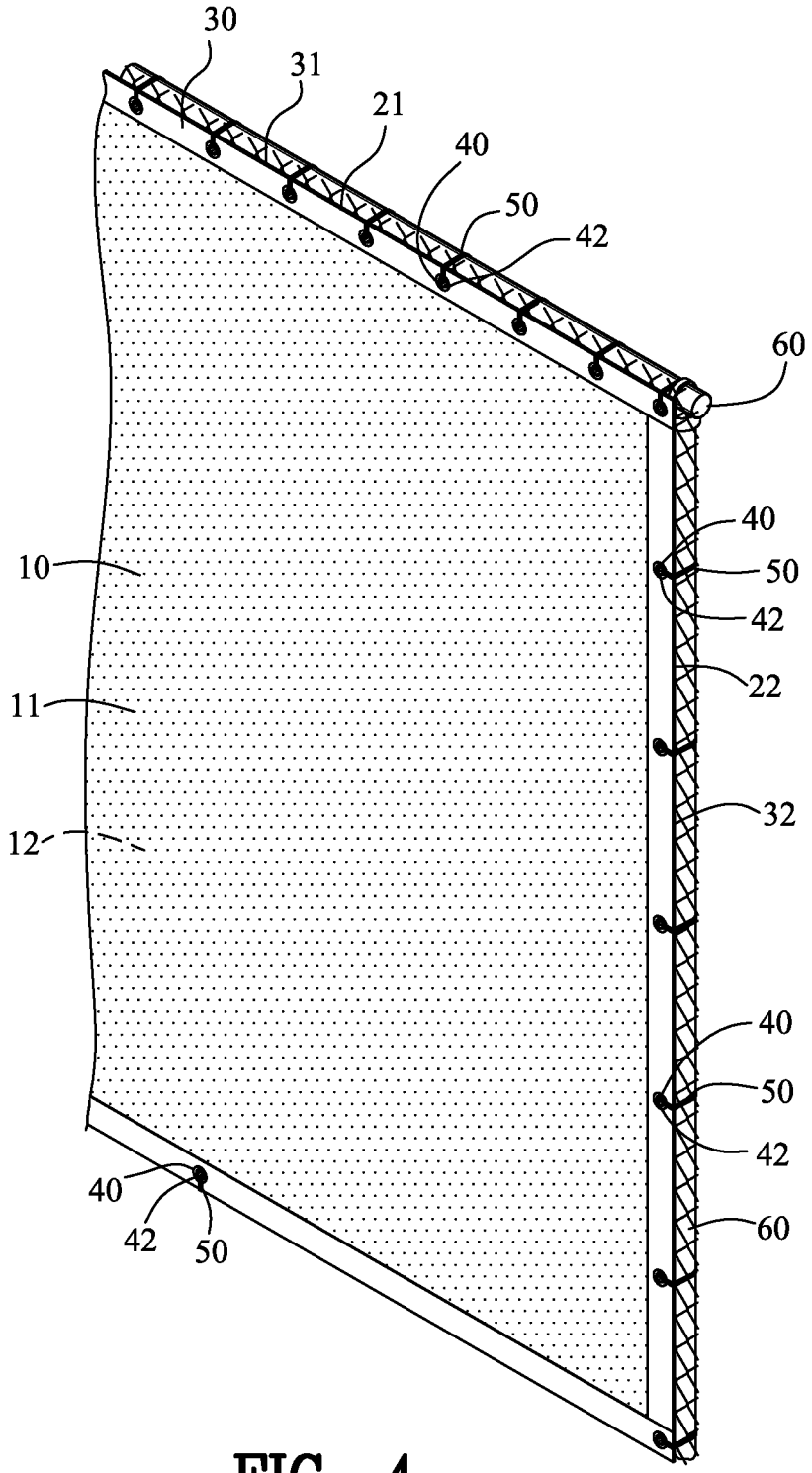
FIG. 4 is an isometric view of the portable acoustical blocking system 10 of the present invention secured to a support shown as a fence.

FIG. 4 is an isometric view of the portable acoustical blocking system 10 of the present invention secured to a support shown 60 as a fence. It should be appreciated by those skilled in the art that virtually any support may be used to suspend the portable acoustical blocking system 10 including scaffolding, staggered wood shadow box privacy fences, handrails, horizontal supports and the like. The portable acoustical blocking system 10 finds particular use along rail and road transportation.

A plurality of flexible ties 50 secure the plurality of hangers 40 to the support 60 by extending through the grommet apertures 42 and encircling the support 60. In one example, the plurality of flexible ties 50 are metallic cable ties although various types of flexible ties may be used in the present invention.

Figure 5:
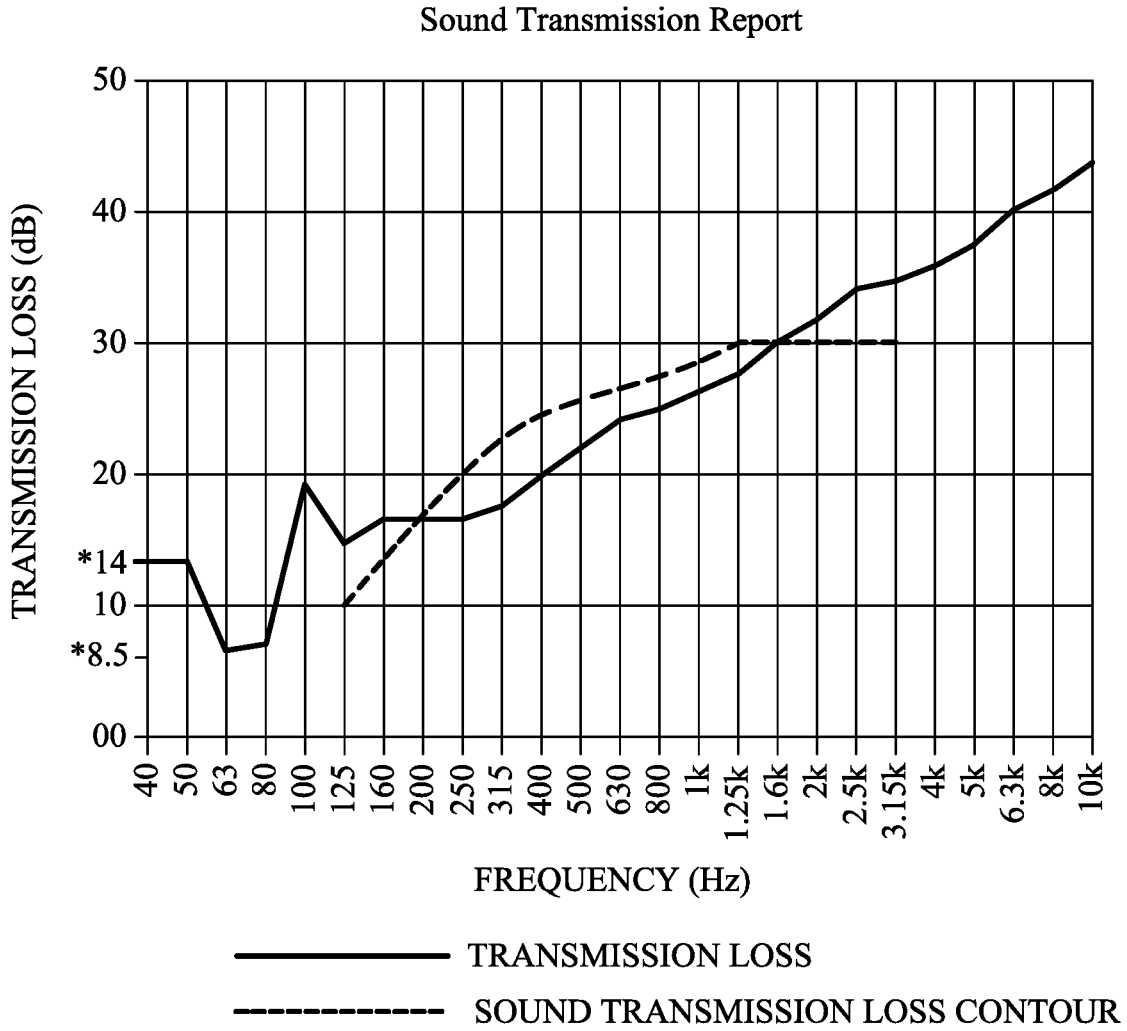
FIG. 5 is a graph of sound transmission loss as a function of frequency for the portable acoustical blocking system of the present invention.

FIG. 5 is a graph of sound transmission loss as a function of frequency for the portable acoustical blocking system 5 of the present invention. The portable acoustical blocking system 5 been tested in independent certified acoustical labs and the sound transmission coefficient (STC) of 28 represents a 85% reduction of sound to the human ear.

Figure 6:
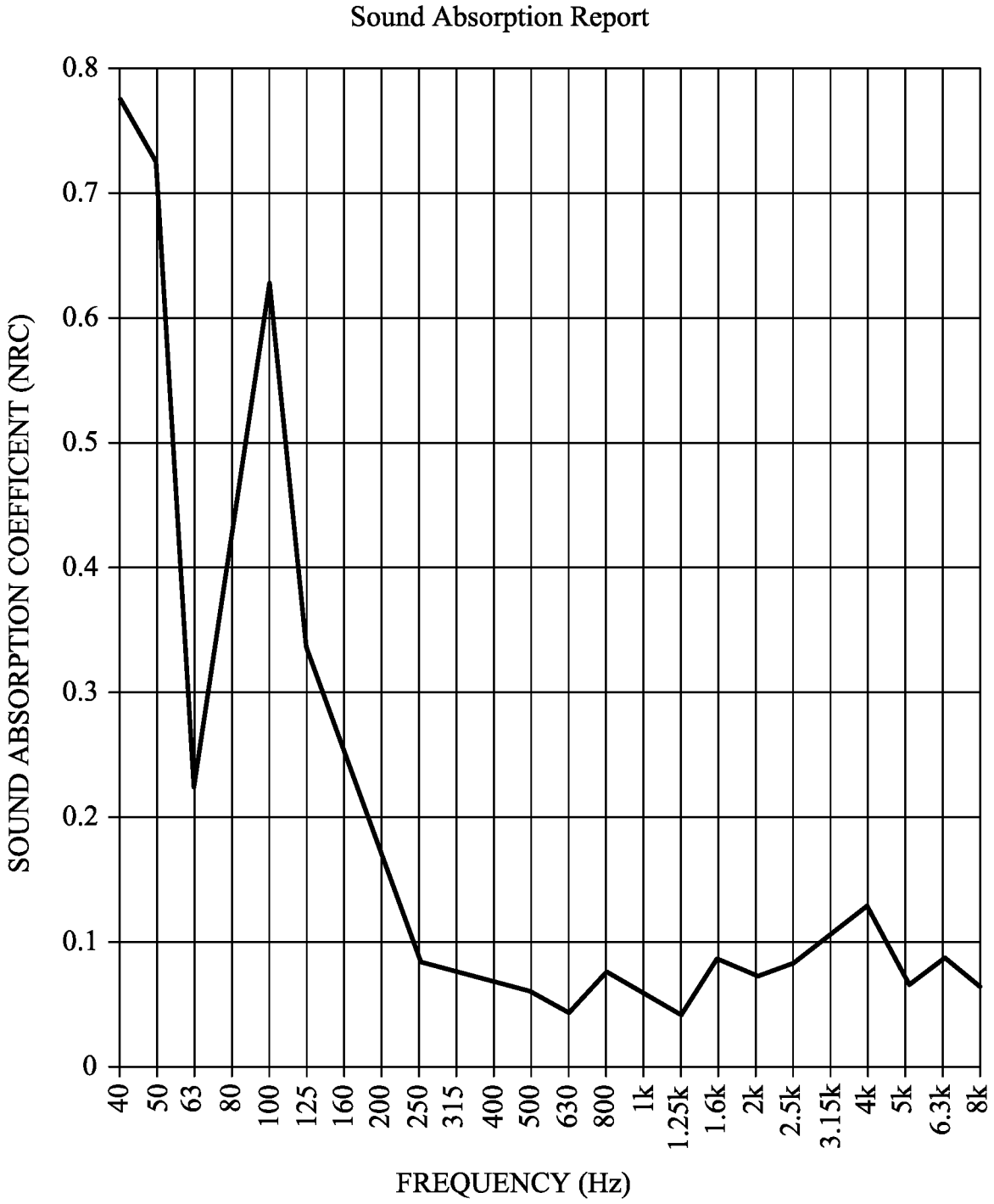
FIG. 6 is a graph of sound absorption as a function of frequency for the portable acoustical blocking system of the present invention.

FIG. 6 is a graph of sound absorption as a function of frequency for the portable acoustical blocking system 5 of the present invention. In frequencies of 50 Hz and below, the heavy limp acoustical blocking material 10 begins to vibrate from low frequency sound waves. The acoustical blocking material 10 transforms low frequency sound waves into mechanical movement and internal friction energy within the acoustical blocking material 10. Laboratory tests indicate that this transformation process reduces these low frequencies from penetrating the acoustical blocking material 10 by over 60 percent relative to the human ear. In addition the acoustical blocking material 10 becomes as an absorbent material in these frequencies with test results showing in an NRC (noise reduction coefficient) as high as 0.78 (1.00 being the max). The acoustical blocking material 10 has a 0.078 NRC (noise reduction coefficient) at the very low freq of 40 Hz and a NRC (noise reduction coefficient) of 0.063 at 100 Hz. The acoustical blocking material 10 not only reduces sound as a barrier, but also acts as an acoustical absorbent material at very low frequencies. Very low frequencies are not reflected as other sound barriers. In contrast to a ridged barrier, the acoustical blocking material 10 mass flexes at low frequencies transforming the acoustical energy into inaudible internal friction energy.

Figure 7:
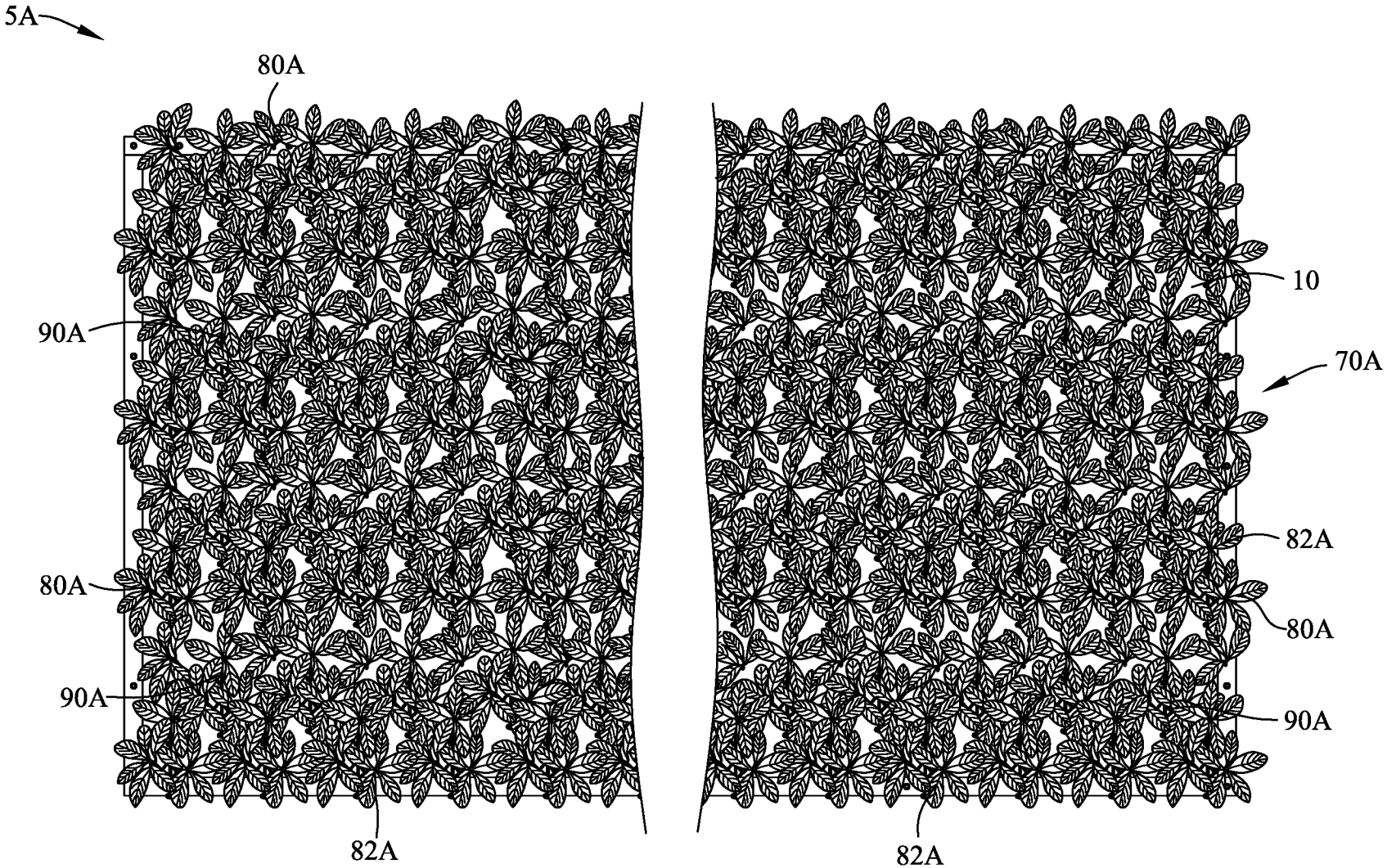
FIG. 7 is a front view of a first embodiment of a portable acoustical blocking system incorporating a decorative component of the present invention.

FIG. 7 is a front view of a first embodiment of a portable acoustical blocking system 5A incorporating a decorative component 70A of the present invention. The decorative component 70A is affixed to the acoustical blocking material 10 shown in FIGS. 1-4. The decorative component 70A provides a pleasant appearance to the acoustical blocking material 10.

In this first embodiment of the portable decorative acoustical blocking system 5A, the decorative component 70A comprises a decorative element 80A supported by a grid frame 90A. The decorative element 80A is shown as a synthetic three-dimensional element representing a synthetic plant growth 80A. As will be described in greater detail hereinafter, the synthetic plant growth 80A is removeably affixed to the acoustical blocking material 10 by the grid frame 90A.

Figure 8:
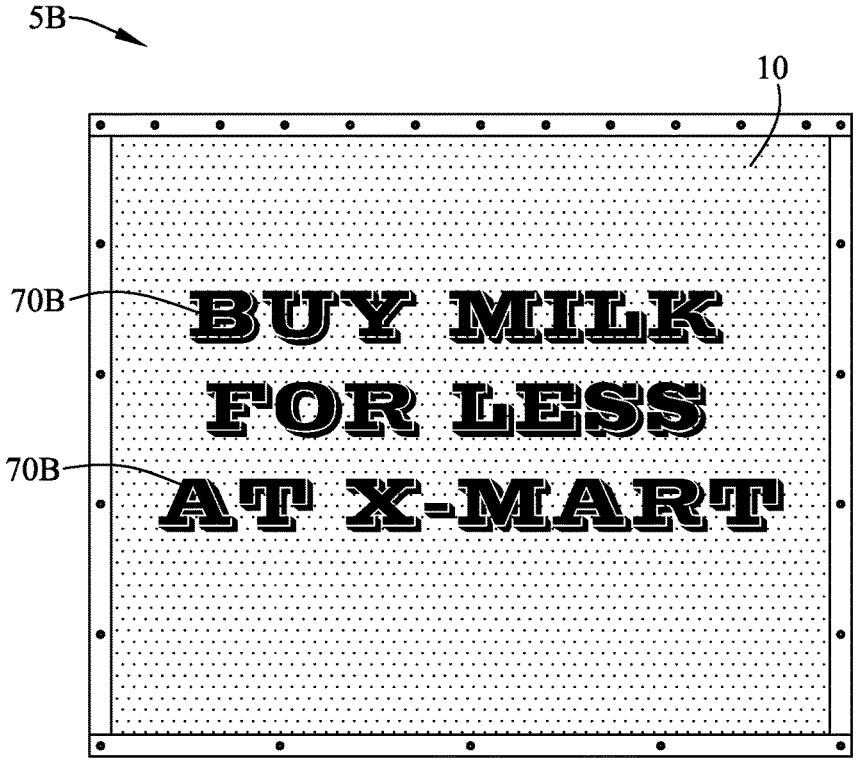
FIG. 8 is a front view of a second embodiment of a portable acoustical blocking system incorporating a decorative component of the present invention.
Figure 9:
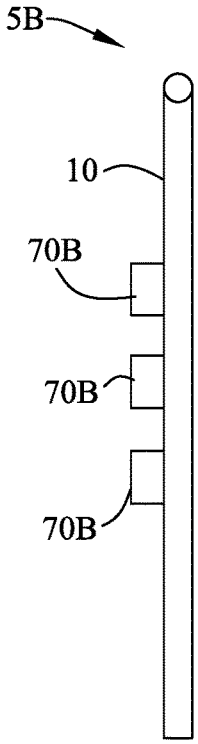
FIG. 9 is a side view of FIG. 8.

FIGS. 8 and 9 are front and side views of a second embodiment of a portable acoustical blocking system 5B incorporating a decorative component 70B. In this second embodiment of the portable decorative acoustical blocking system 5B, the decorative component 70B is shown as a three-dimensional advertisement 80B affixed to the acoustical blocking material 10. The three-dimensional advertisement 80B may be either removeably affixed or may be permanently affixed to the acoustical blocking material 10. In one example, three-dimensional advertisement 80B is permanently secured to the acoustical blocking material 10 by a conventional adhesive.

Figure 10:
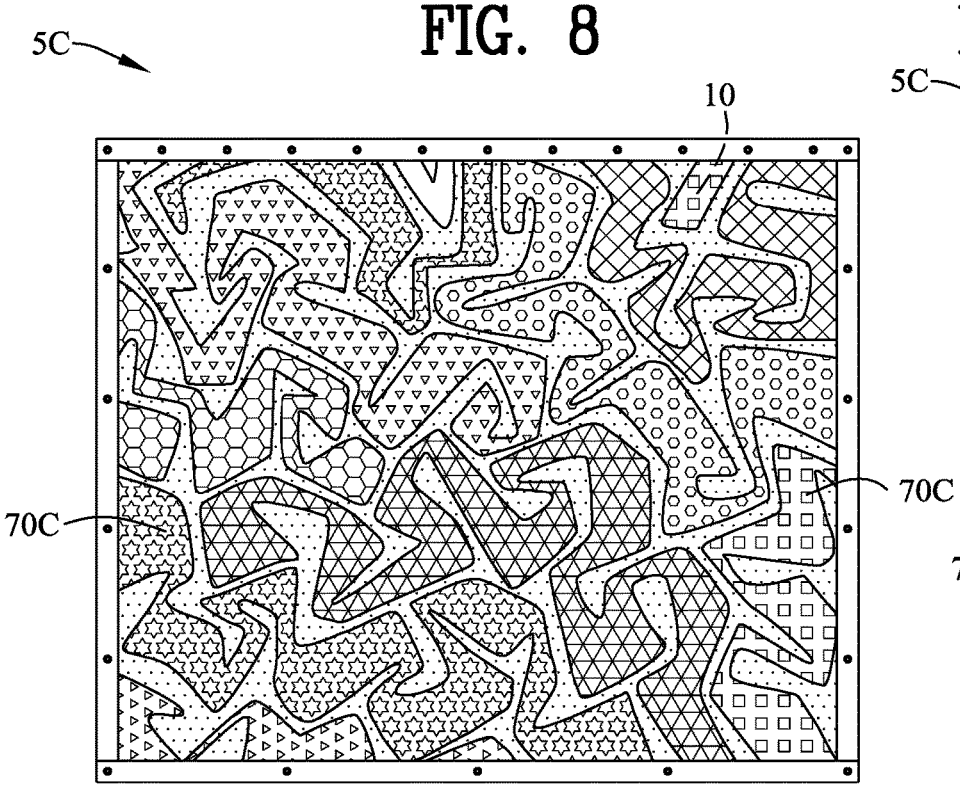
FIG. 10 is a front view of a third embodiment of a portable acoustical blocking system incorporating a decorative component of the present invention.
Figure 11:
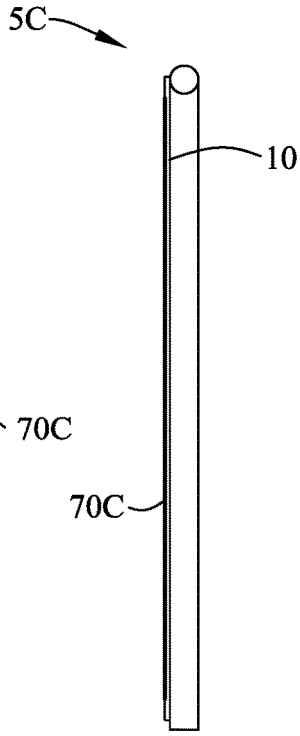
FIG. 11 is a side view of FIG. 10.

FIGS. 10 and 11 are front and side views of a third embodiment of a portable acoustical blocking system 5C incorporating a decorative component 70C. In this second embodiment of the portable decorative acoustical blocking system 5C, the decorative component 70B is shown as a two-dimensional work of art 80 C permanently affixed to the acoustical blocking material 10. The two-dimensional work of art 80 C may be an original artwork, a copy of fine art work or may be "street art" as found in many urban areas.

Figure 12:
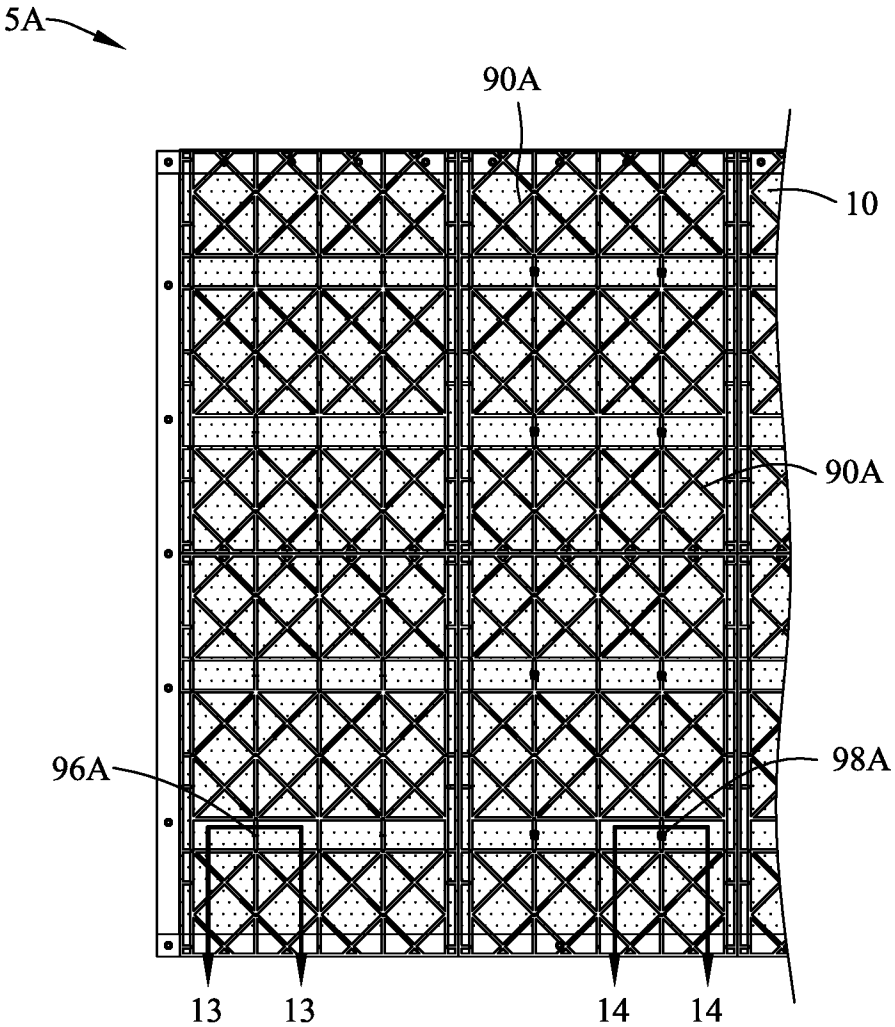
FIG. 12 is a front view of a portion of the portable decorative acoustical blocking system of FIG. 7 illustrating a grid frame affixed to the acoustical blocking material.

FIG. 12 is a front view of a portion of the portable decorative acoustical blocking system 5A of FIG. 7. The grid frame 90A supports the decorative element 80A to form the decorative component 70A. The grid frame 90A provides a grid matrix for removeably affixing the decorative element 80 A.

Figure 13:
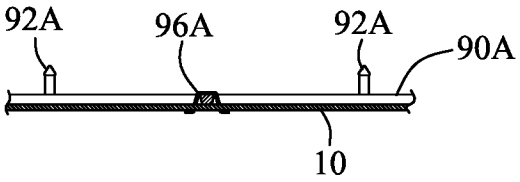
FIG. 13 is a sectional view along line 13-13 in FIG. 12.

FIG. 13 is a side sectional view of a portion of FIG. 12 illustrating a staple 96A affixing the grid frame 90A to the acoustical blocking material 10. The staples 96A permanently affix the grid frame 90A to the acoustical blocking material 10. A plurality of projections 92A extend from multiple positions of the grid frame 90A.

Figure 14:
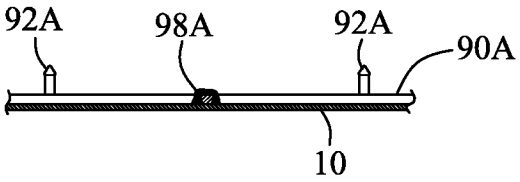
FIG. 14 is a sectional view along line 14-14 in FIG. 12.

FIG. 14 is a side sectional view of a portion of FIG. 12 illustrating an adhesive 98A affixing the grid frame 90A to the acoustical blocking material 10. The adhesive 98A permanently affixes the grid frame 90A to the acoustical blocking material 10.

Figure 15:
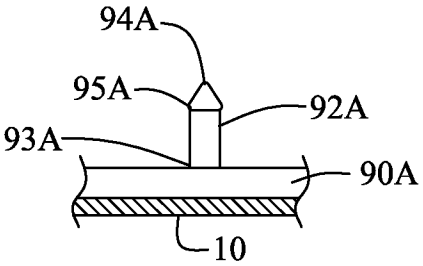
FIG. 15 is an enlarged view of the projections shown in FIGS. 13 and 14.

FIG. 15 is an enlarged view of the plurality of projections 92A extending from the grid frame 90A. Each of the plurality of projections 92A extends from a proximal end 93A and a distal end 94A. The distal ends 94A include an enlarged portion 95A.

Figure 17:
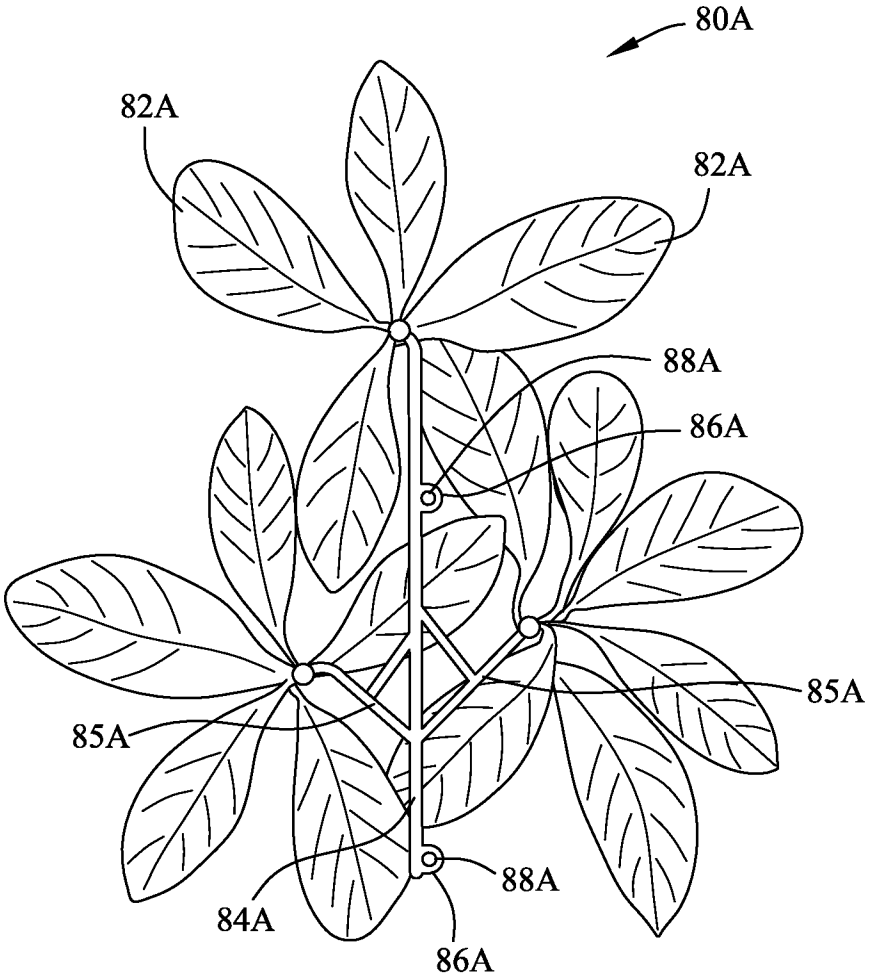
FIG. 17 is a rear view of FIG. 16.
Figure 16:
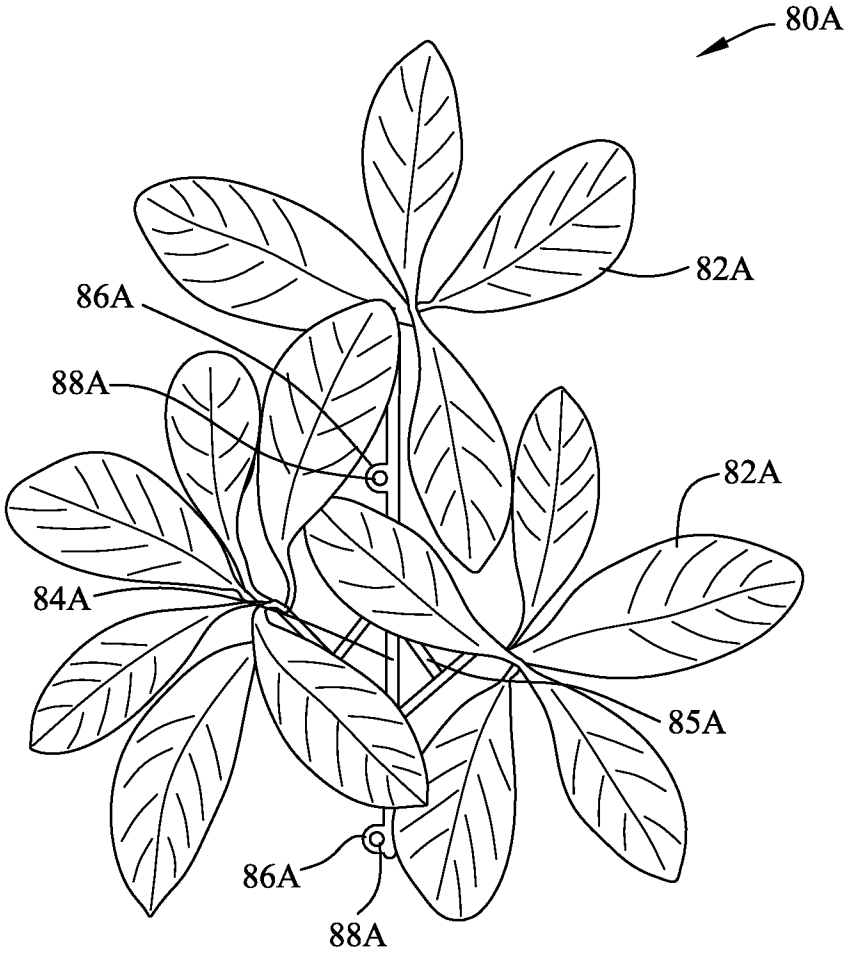
FIG. 16 is a front view of a portion of the portable decorative acoustical blocking system of FIG. 7 illustrating a three dimensional synthetic plant growth.

FIGS. 16 and 17 are front and rear views of the decorative element 80A of the portable decorative acoustical blocking system of FIG. 7. The decorative element 80A comprises a plurality of leaves 82A interconnected by connectors 83A. In this example, the connectors 83A include major connectors 84A and minor connectors 85A. The minor connectors 85A connect the leaves 82A to the major connectors 84A. A plurality of rings 86A extend from the major connectors 84A. Each of the plurality of rings 86A has an aperture 88A.

Preferably, the plurality of leaves 82A including the major and minor connectors 84A and 85A as well as the plurality of rings 86A are formed from a one piece polymeric material. Only a portion of each of the plurality of rings 86A is affixed to the major connectors 84A enabling the rings 86A and the aperture 88A to be resiliently expanded. The smaller dimension of the aperture 88A enables the aperture 88A to resiliently engage the projections 92A.

FIG. 17 is a view similar to FIG. 13 illustrating the removable connection of the three dimensional synthetic plant growth of FIG. 15 and the grid frame of FIG. 12. The aperture 88A is forced over the enlarged portion 95A at the distal end of the projection 92 enabling the rings 86A to resiliently expanded and to subsequently engage the projections 92A.

Figure 18:
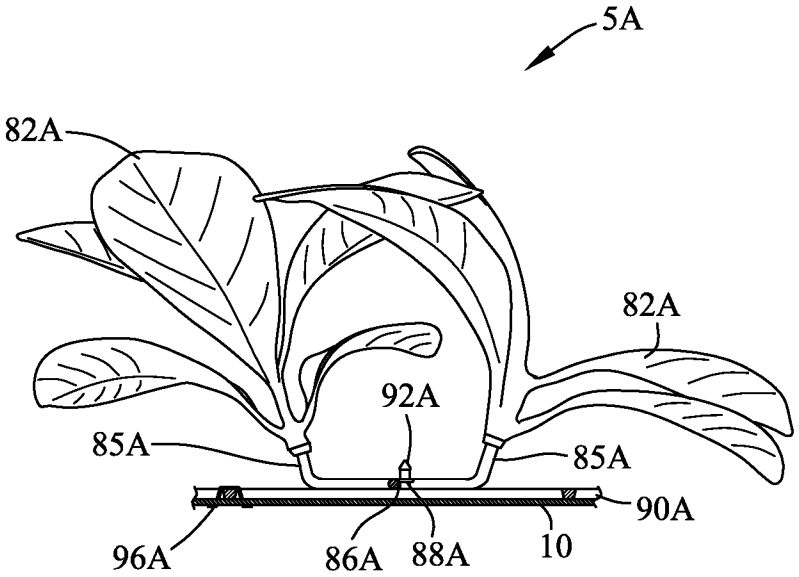
FIG. 18 is a view similar to FIG. 13 illustrating the connection of the three dimensional synthetic plant growth of FIG. 16 and the grid frame of FIG. 12 stapled onto the acoustical blocking material.

FIG. 18 is a view similar to FIG. 14 illustrating the removable connection of the three dimensional synthetic plant growth of FIG. 16 and the grid frame of FIG. 12. The plurality of leaves 82A function to dissipate acoustical energy prior to impinging upon the acoustical blocking material 10 as indicated by the arrows. The addition of the plurality of leaves 82A dissipating acoustical energy increases the acoustical performance set forth in the graph in FIGS. 5 and 6.

Figure 19:
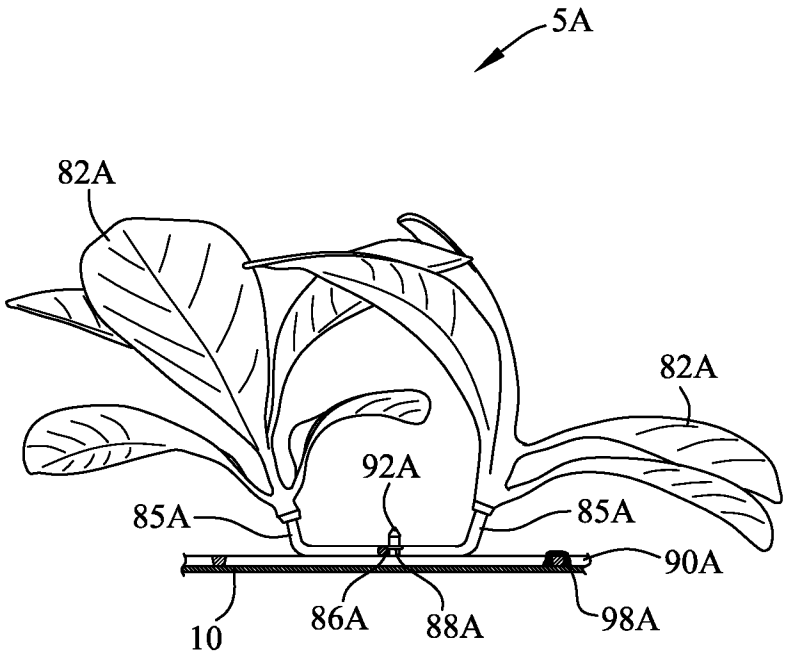
FIG. 19 is a view similar to FIG. 14 illustrating the removable connection of the three dimensional synthetic plant growth of FIG. 16 and the grid frame of FIG. 12 glued onto the acoustical blocking material.

FIG. 19 is a view similar to FIG. 14 illustrating the removable connection of the three dimensional synthetic plant growth of FIG. 16 and the grid frame of FIG. 12 glued onto the acoustical blocking material 10. An adhesive 98A affixes the grid frame 90A to the acoustical blocking material 10.

FIGS. 20-26 illustrate a first embodiment of a portable acoustical road barrier 105 comprising an acoustical blocking panel 110 mounted on a road barrier 120. The road barrier 120 is defined by a first and a second side 121 and 122 and an upper surface 124. The road barrier 120 extends between a first end 125 and a second end 126. In this example, the road barrier is shown as a precast concrete traffic barrier well known to those skilled in the art. Precast concrete traffic barrier are typically used for reduce the risk of an out-of-control vehicle crossing the median and colliding with opposing traffic or roadway workers. Precast concrete traffic barrier are also used for directing traffic in a prescribed manner as well as protection against unwanted vehicular traffic around government buildings, utility facilities, historic landmarks, airports and the like. The present invention is adaptable to ASTM C 825 and NCHRP 350 precast concrete barriers as well as other types, styles and materials of road and non-road barriers.

Figure 20:
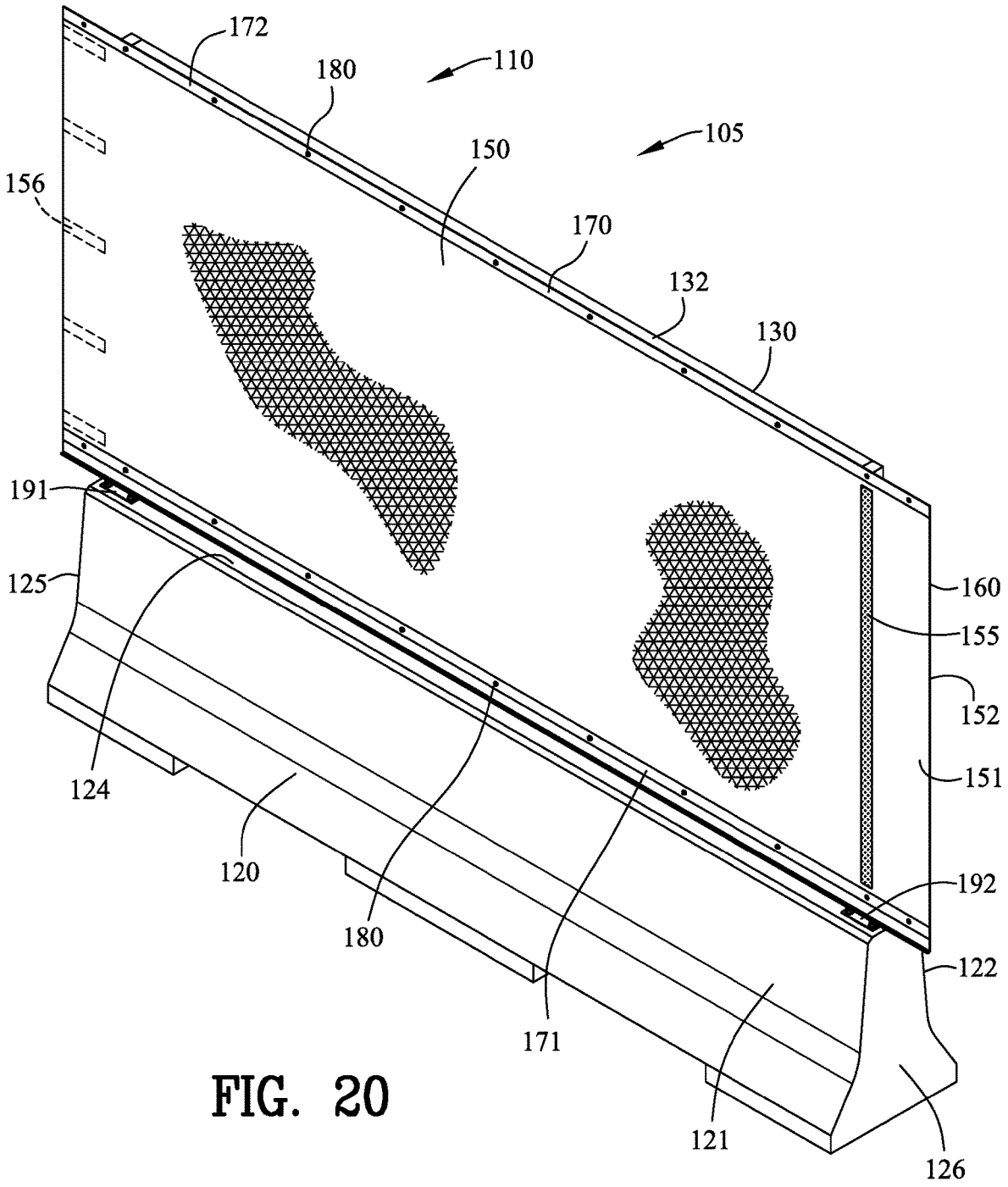
FIG. 20 is an isometric front view of a first embodiment of a portable acoustical road barrier.
Figure 21:
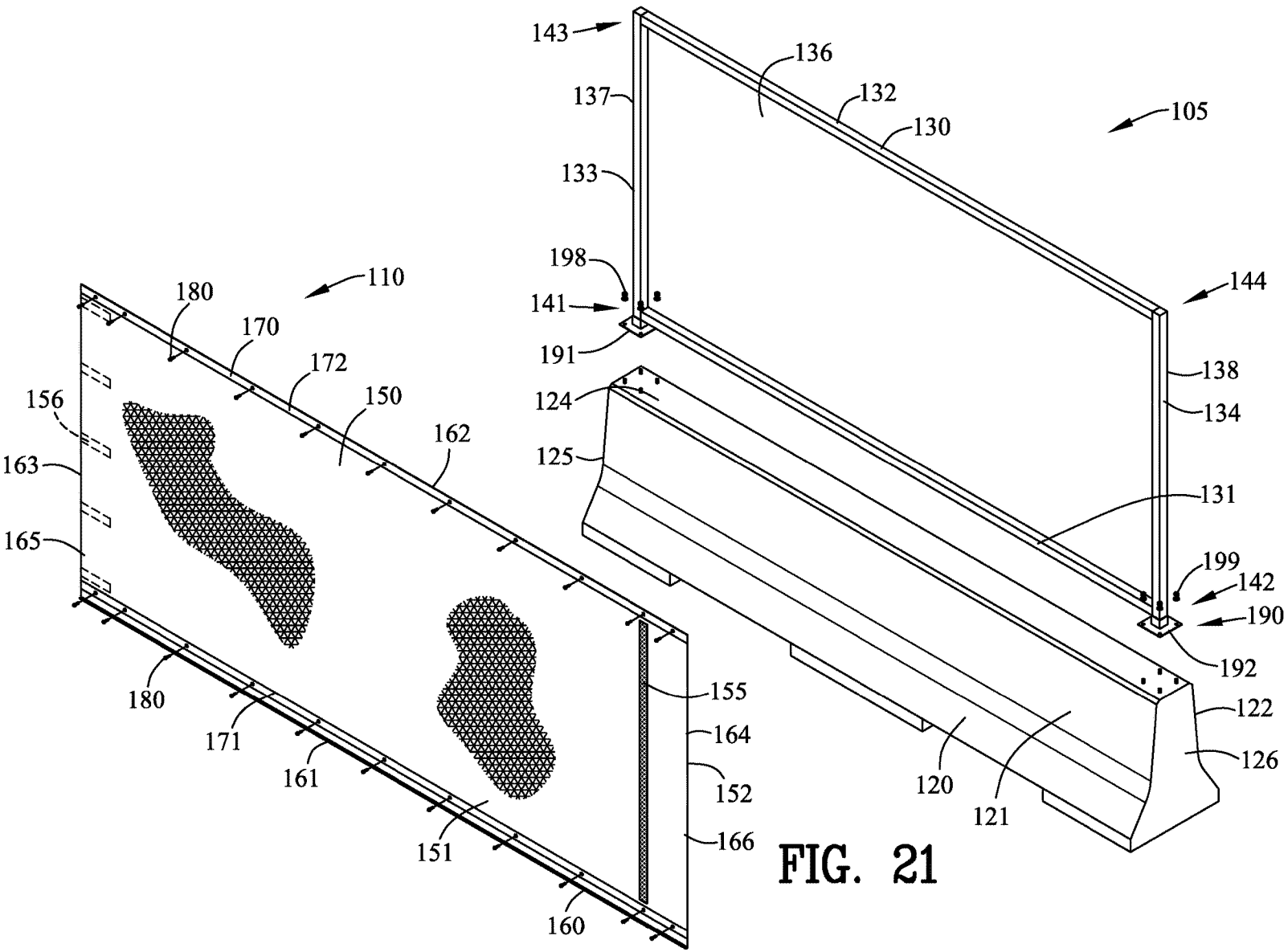
FIG. 21 is an exploded isometric front view of the portable acoustical road barrier of FIG. 20.
Figure 22:
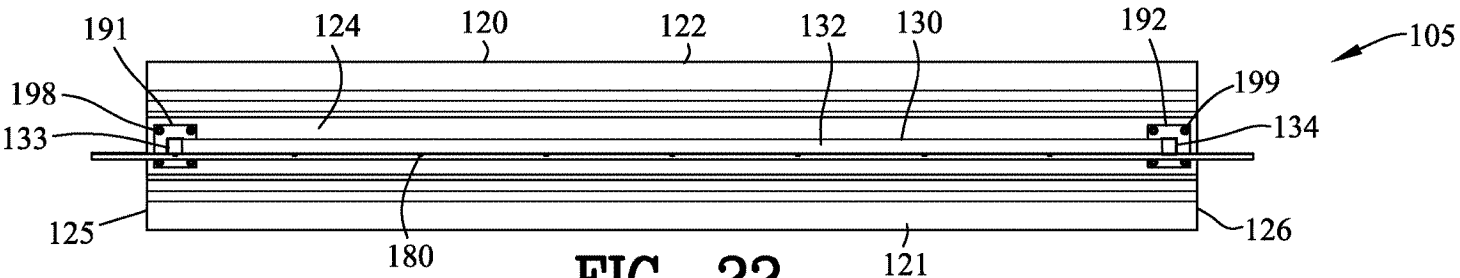
FIG. 22 is a top view of the portable acoustical road barrier of FIG. 20.
Figure 23:
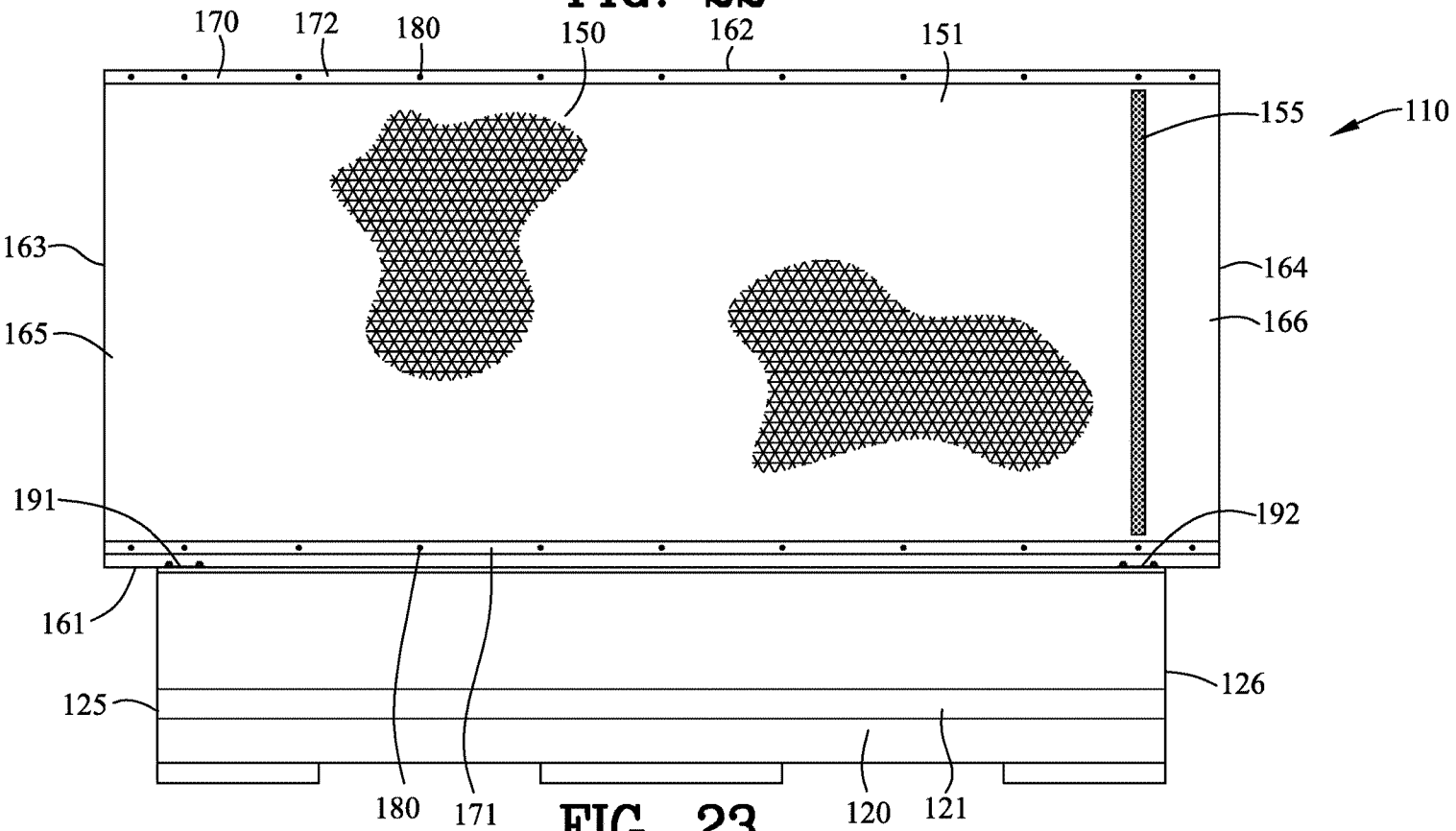
FIG. 23 is a front view of the portable acoustical road barrier of FIG. 20.
Figures 24, 25, 26:
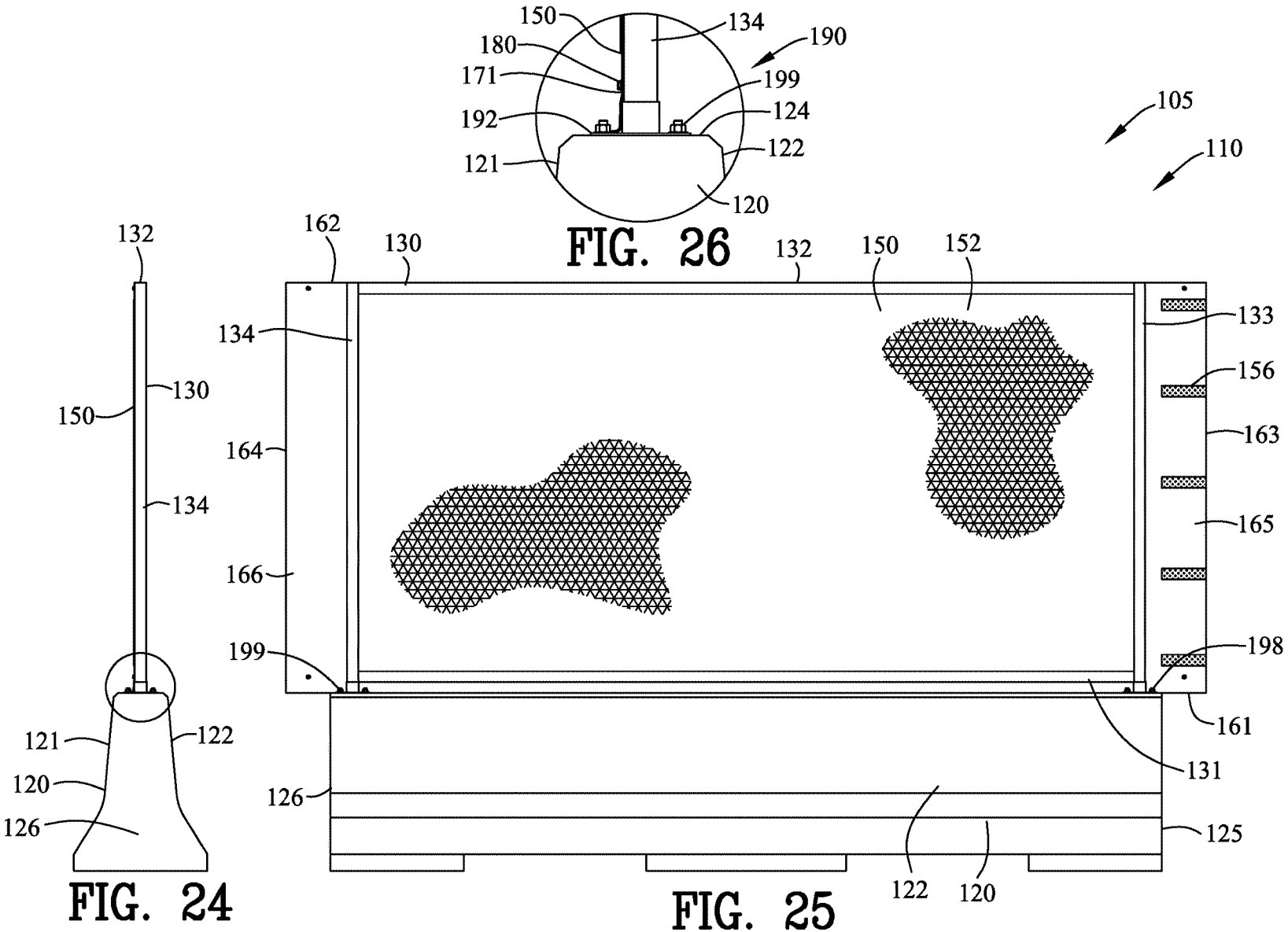
FIG. 24 is a side view of FIG. 23.
FIG. 25 is a front view of FIG. 23.
FIG. 26 is an enlarged view of a portion of FIG. 24.

FIG. 21 is an exploded view of FIG. 20 further illustrating the portable acoustical road barrier 105 comprising a panel frame 130 and the acoustical blocking material 150. The panel frame 130 has a lower panel frame portion 131 and plural vertical panel frame portions 133 and 134 and an upper horizontal panel frame portion 132. The acoustical panel frame 130 defines an open acoustical aperture 136. The acoustical panel frame 130 extends between a first end 137 and a second end 138.

The lower horizontal panel frame portion 131 is assembled to the first and second vertical panel frame portion 133 and 134 by lower connectors 141 and 142. The upper horizontal panel frame portion 134 is assembled to the first and second vertical panel frame portion 133 and 134 by upper connectors 143 and 144. The lower connectors 141 and 142, the upper connectors 143 and 144 may be any suitable type of fastener for securing the panel frame portions 131-134.

The acoustical blocking material 150 has a first side surface 151 and a second side surface 152. A first side hook fasteners 155 is located on the first side surface 151 of the acoustical blocking material 150 whereas a second side loop fasteners 156 is located on the second side surface 152 of the acoustical blocking material 150. It should be appreciated by those skilled in the art that the hook fasteners 155 and the loop fasteners 156 may be interchanged between the first and second side surfaces 151 and 152 of the acoustical blocking material 150. Although the hook and loop fasteners 155 and 156 are shown to temporarily fasten adjacent acoustical blocking materials 150, it should be understood that other means may be used to temporarily fasten adjacent acoustical blocking materials 150 as should be appreciated by those skilled in the art.

As it will be described in greater detail with reference to FIGS. 27 and 28, the hook and loop fasteners 155 and 156 are used to fasten adjacent acoustical blocking materials 150 together to form a continuous acoustical blocking materials web. The sheet of acoustical blocking material 150 is bound by a material edge 160. In this example, the sheet of acoustical blocking material 160 is bound by a bottom material edge 161, a top material edge 162, a left side material edge 163 and a right material edge 164. The material edges 161-164 define a perimeter of the sheet of acoustical blocking material 150.

The left side material edge 163 and the right material edge 164 of the sheet of acoustical blocking material 150 defines a left and right overhang 165 and 166 that extend beyond the vertical panel frame portions 133 and 134 of the panel frame 130. As it will be described in greater detail with reference to FIGS. 27 and 28, the hook left and right overhang 165 and 166 are used to form a continuous acoustical blocking materials web.

In this example, the sheet of acoustical blocking material 150 has a thickness of approximately one-eighth of an inch. The acoustical blocking material 150 comprise a heavy mineral filled, barium free visco elastic acoustical material having a density of greater than one pound per square foot. The sheet of acoustical blocking material 150 is flexible for enabling the sheet of acoustical blocking material 10 to be rolled for transportation and/storage.

A reinforcing tape 170 affixed to the first side 151 of the sheet of acoustical blocking material 160. In this example, a reinforcing tape 171 is affixed to the bottom material edge 161 and a reinforcing tape 172 is affixed to the top material edge 162.

The reinforcing tape 170 is heat welded to the first side 151 of the sheet of acoustical blocking material 150. In the heat welding process, both the first side 151 of the sheet of acoustical blocking material 150 and the reinforcing tape 170 are simultaneously heated to an appropriate temperature. After the acoustical blocking material 150 and the reinforcing tape 170 are simultaneously heated to the appropriate temperature, the reinforcing tape 170 is pressed upon the first side 151 of the sheet of acoustical blocking material 150. In one example, the reinforcing tape comprises a woven polyester material but it should be understood that various other materials may be used as a reinforcing tape 170.

The acoustical blocking material 150 is affixed to the acoustical panel frame 130 to form the acoustical blocking panel 110. A plurality of fasteners 180 extend through the reinforcing tape 170 and the sheet of acoustical blocking material 150 into the acoustical panel frame 130. The reinforcing tape 170 provides structural strength to the plurality of fasteners 180 for suspending and securing the sheet of acoustical blocking material 150 on the acoustical panel frame 150. In this example, the plurality of fasteners 180 are shown as screws but it should be understood by those skilled in the art and that the plurality of fasteners 180 may take various configurations. For example, the fasteners 240 may take the form of adhesives such as conventional adhesives, double back tape, hook and loop fasteners and the like.

The acoustical blocking panel 110 comprises a mount 190 for securing the acoustical blocking panel 110 to the road barrier 120. In this example, the mount 190 comprises a first mount 191 extending from a first end 137 of the panel frame 130 for removably securing the panel frame 130 to the first end 125 of the road divider 120. The mount 190 comprises a second mount 192 extending from a second end 138 of the panel frame 130 for removably securing the panel frame 130 to the second end 126 of the road divider 120.

In this first embodiment of the portable acoustical road barrier 105, the first and second mounts 191 and 192 comprise flanges secured to the left and right sides 133 and 134 of the panel frame 130. The first and second flanges 191 and 192 are secured adjacent to the first and second ends 125 and 126 of the road barrier 120 by fasteners 199 shown as large screws or the like.

Figure 27:
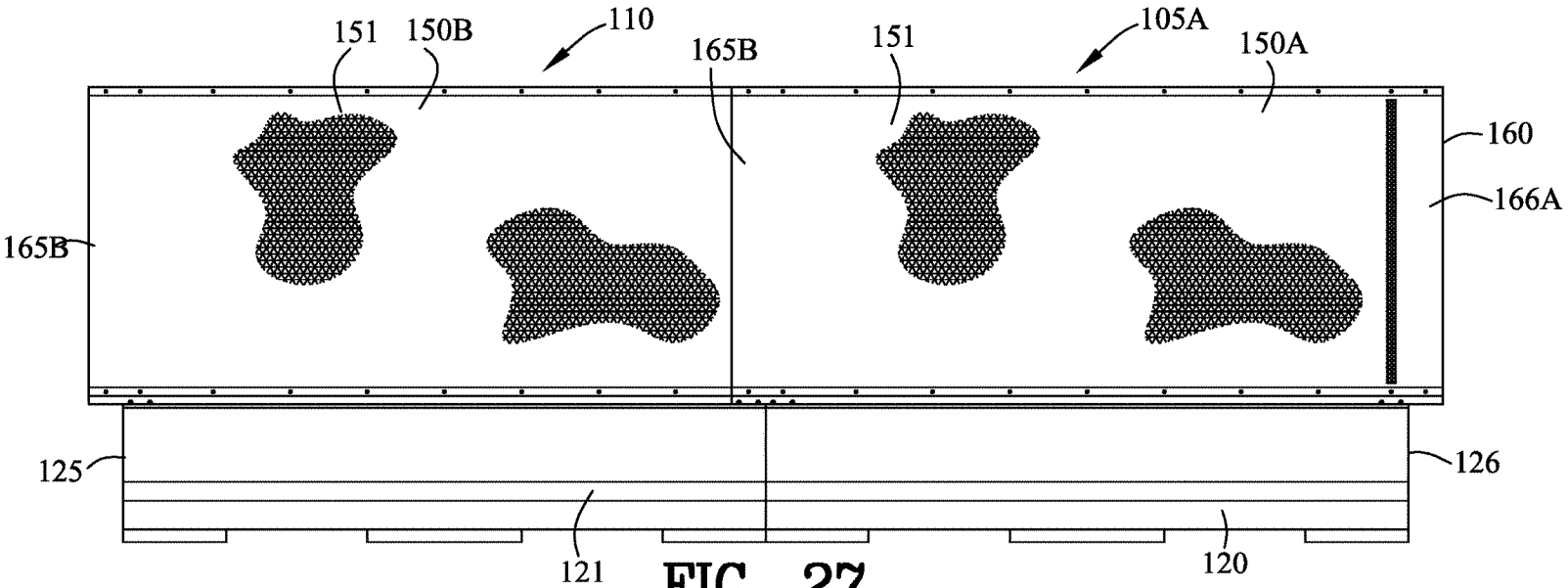
FIG. 27 is a front view of the interconnection of two of the portable acoustical road barriers of FIG. 20.
Figure 28:
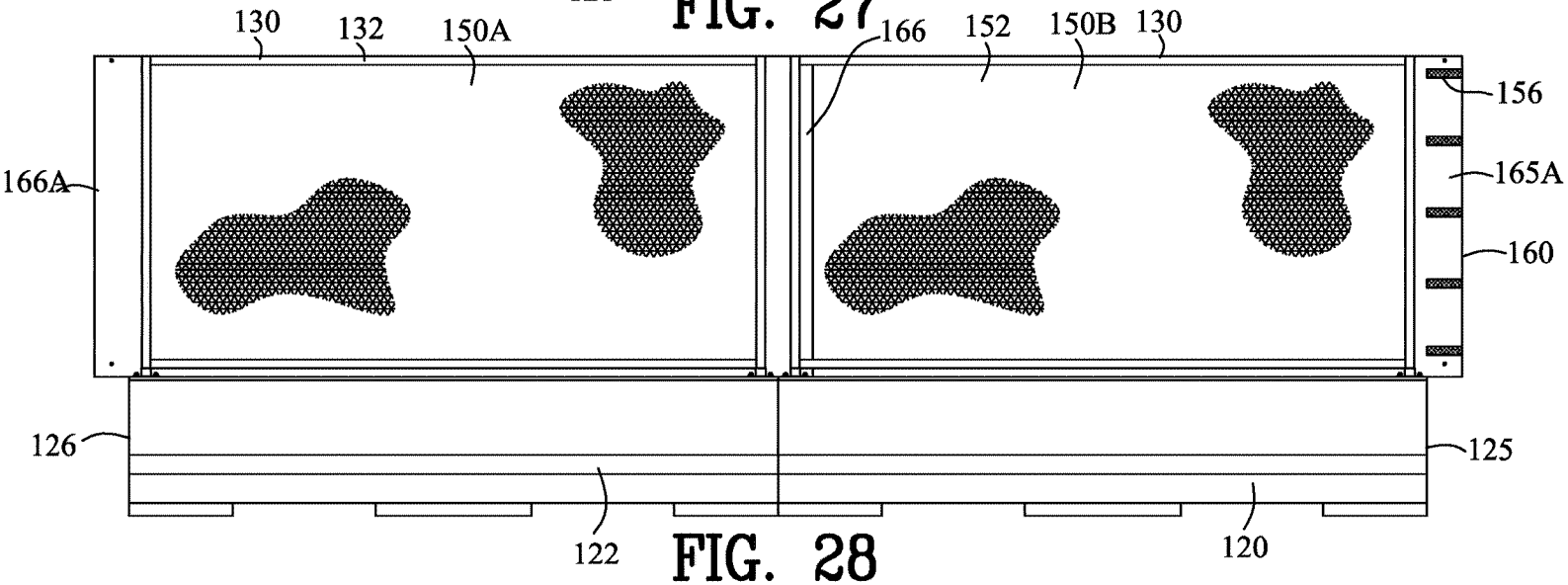
FIG. 28 is a rear view of FIG. 27.
Figure 29:
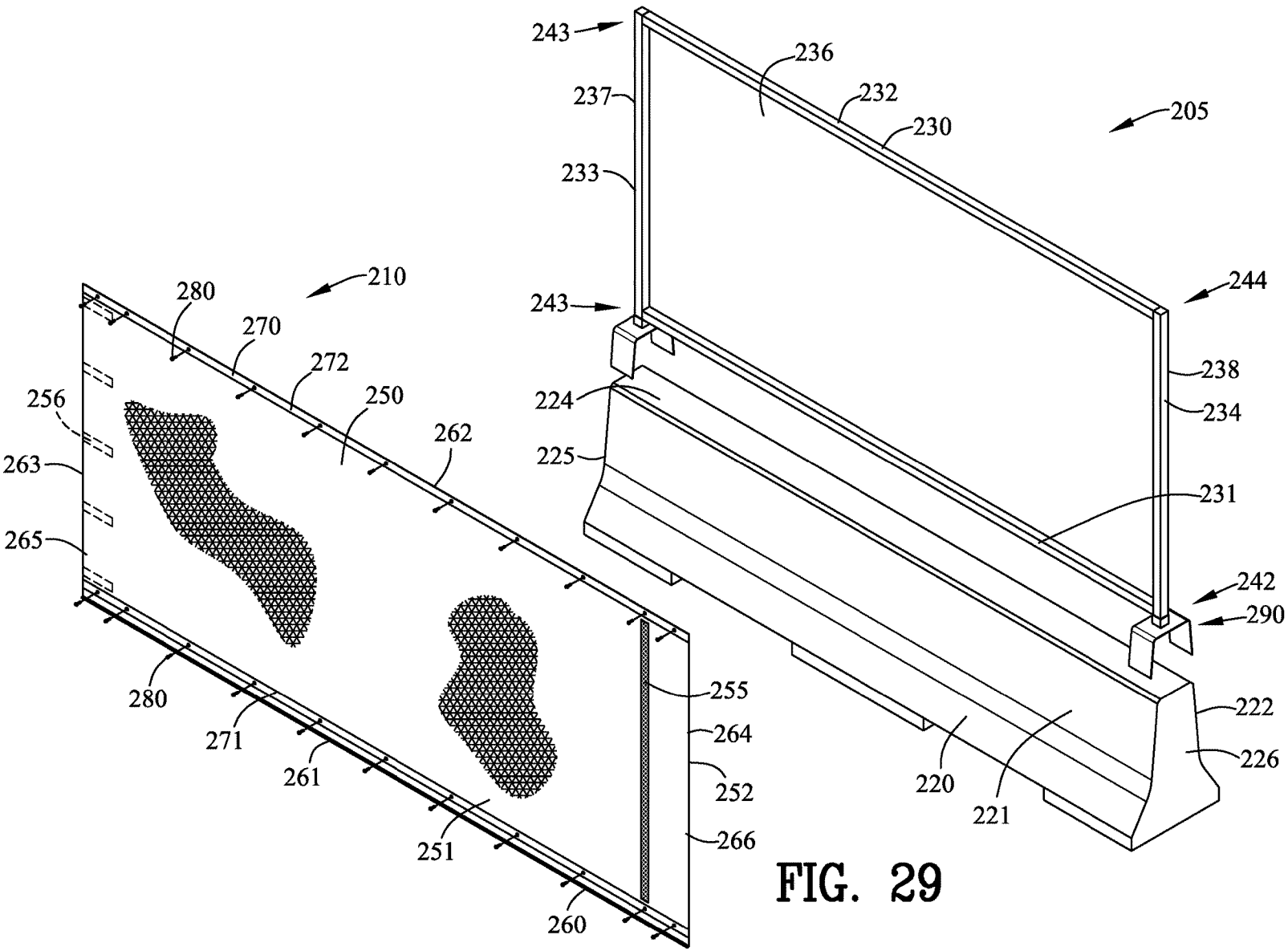
FIG. 29 is an exploded isometric front view of a second embodiment of a portable acoustical road barrier.
Figure 30:
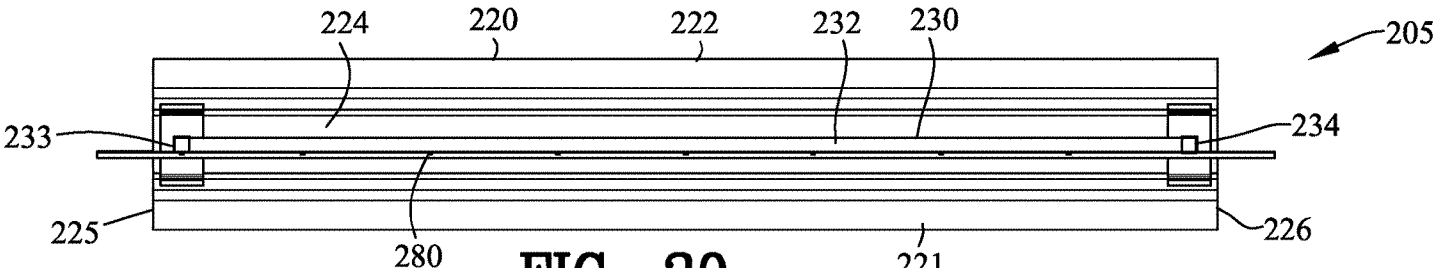
FIG. 30 is a top view of the portable acoustical road barrier of FIG. 29.
Figure 31:
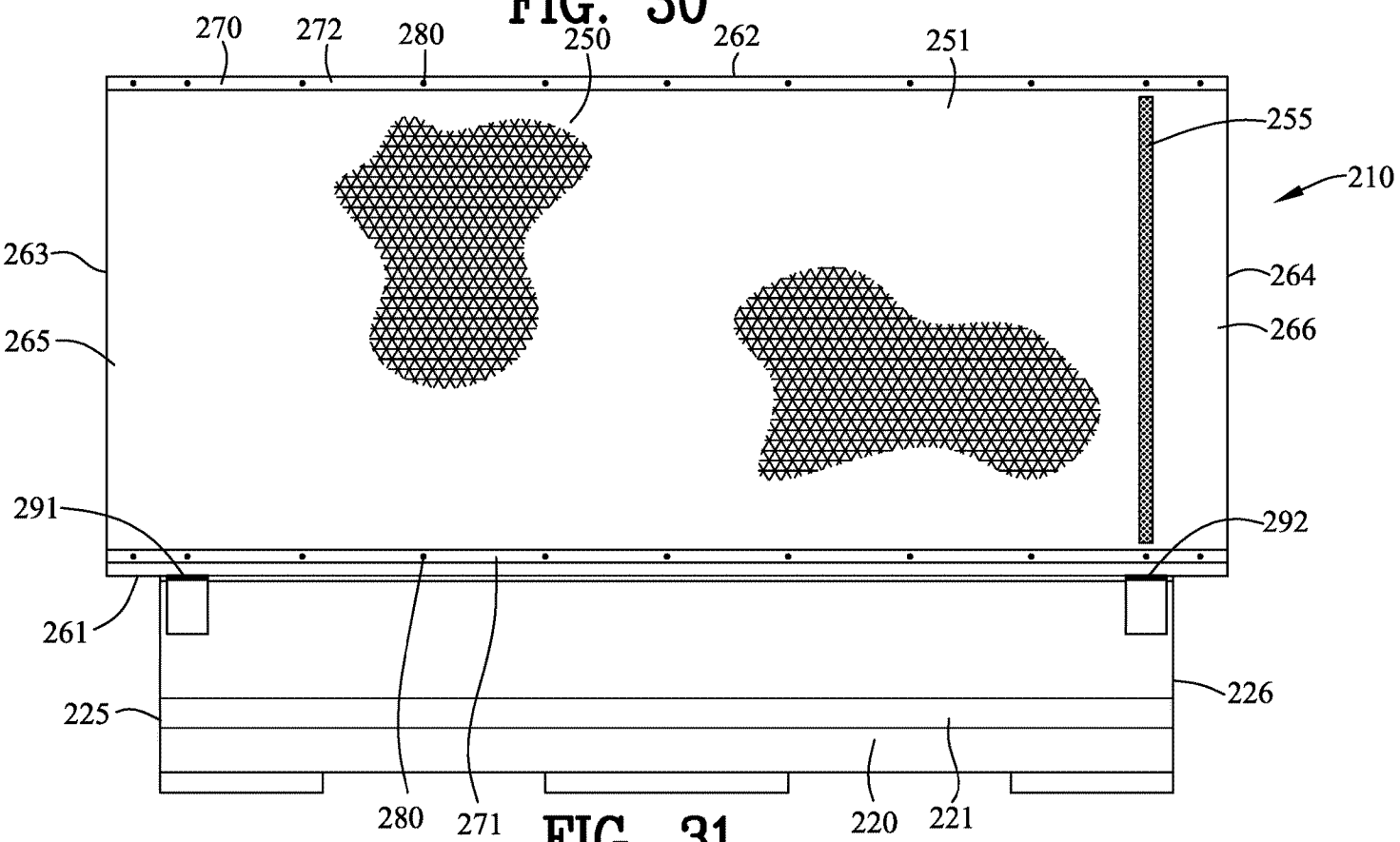
FIG. 31 is a front view of the portable acoustical road barrier of FIG. 29.
Figure 34:
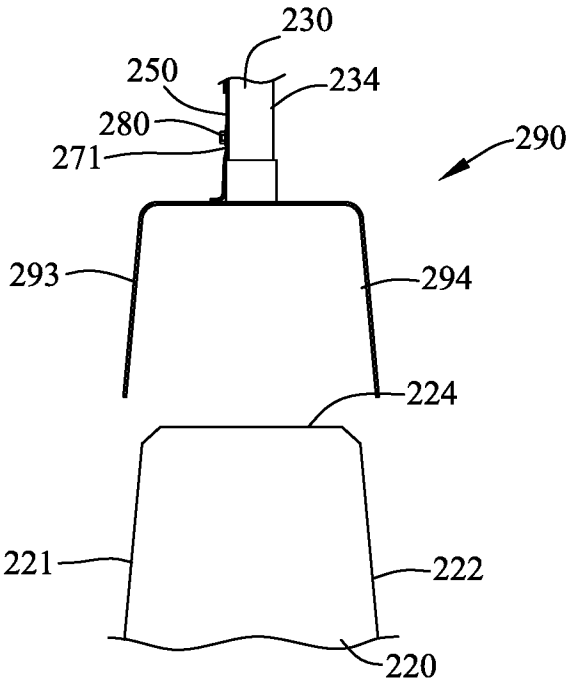
FIG. 34 is an exploded view of FIG. 33.
Figure 33:
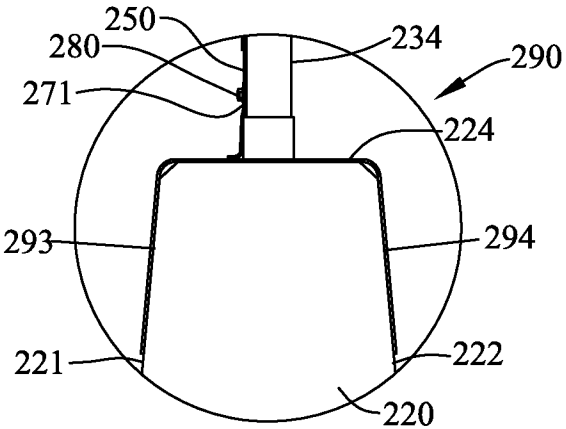
FIG. 33 is an enlarged view of a portion of FIG. 32.
Figure 32:
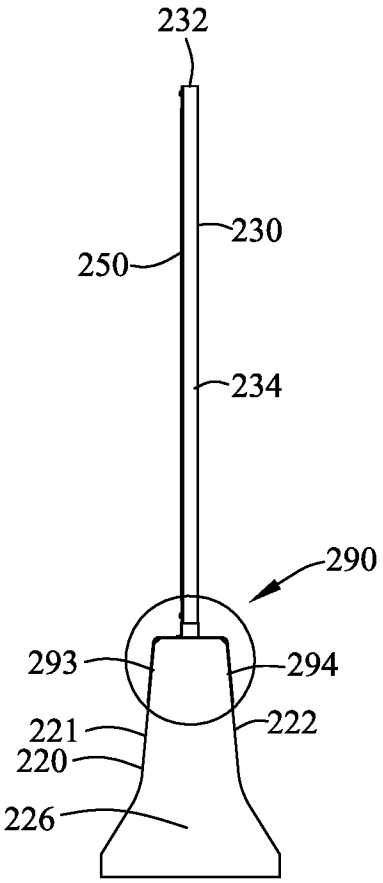
FIG. 32 is a right side view of FIG. 31.
Figure 35:
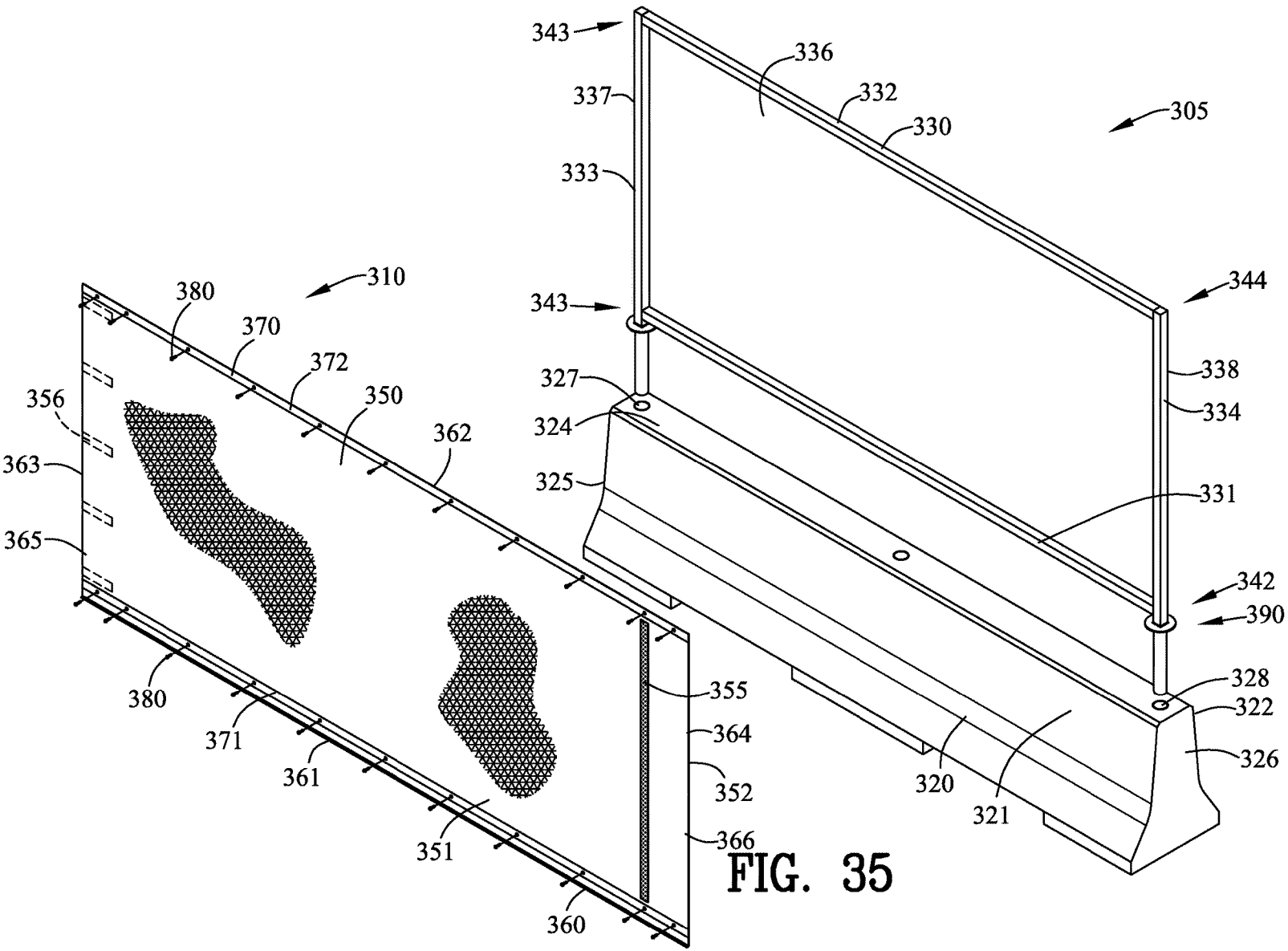
FIG. 35 is an exploded isometric front view of a third embodiment of a portable acoustical road barrier.
Figure 36:
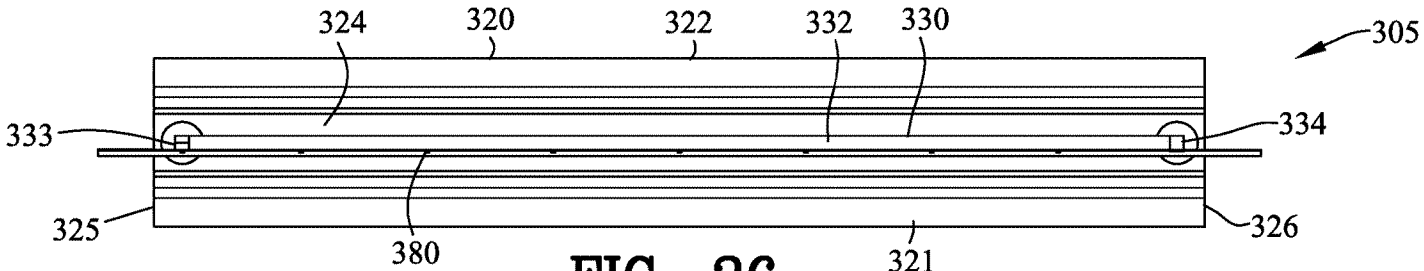
FIG. 36 is a top view of the portable acoustical road barrier of FIG. 35.
Figure 37:
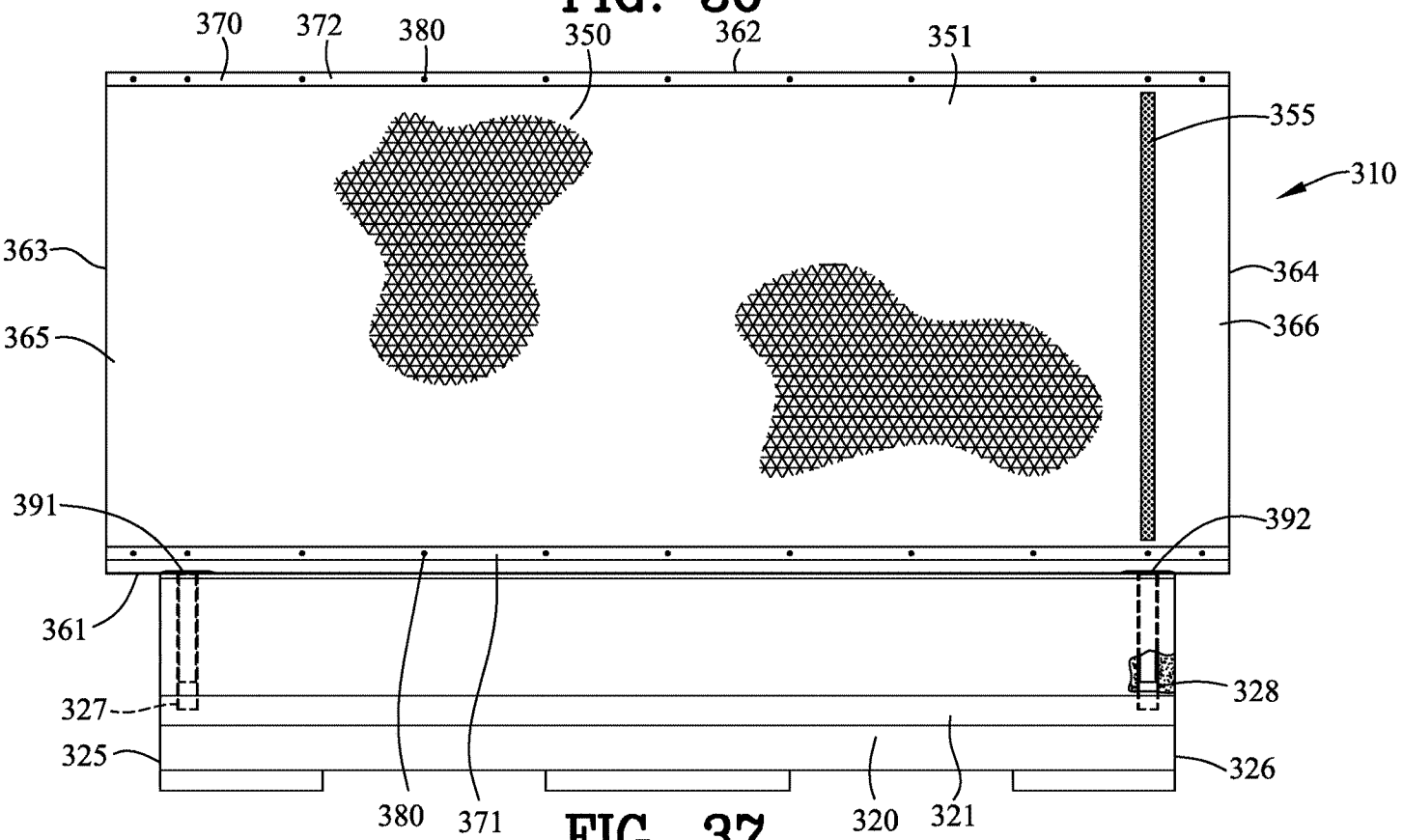
FIG. 37 is a front view of the portable acoustical road barrier of FIG. 36.
Figure 40:
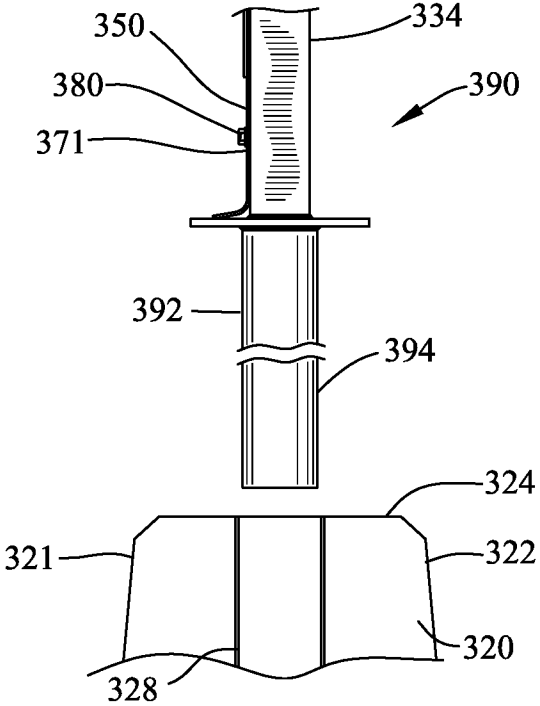
FIG. 40 is an exploded view of FIG. 39.
Figure 39:
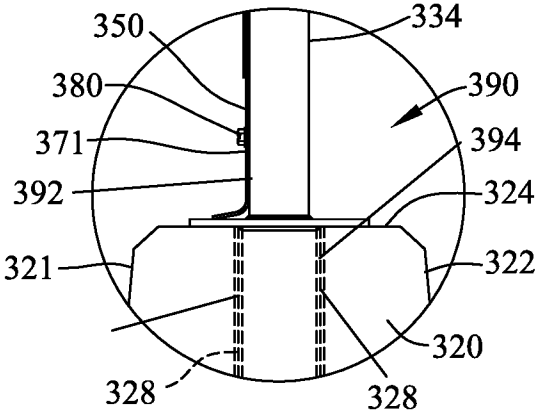
FIG. 39 is an enlarged view of a portion of FIG. 38.
Figure 38:
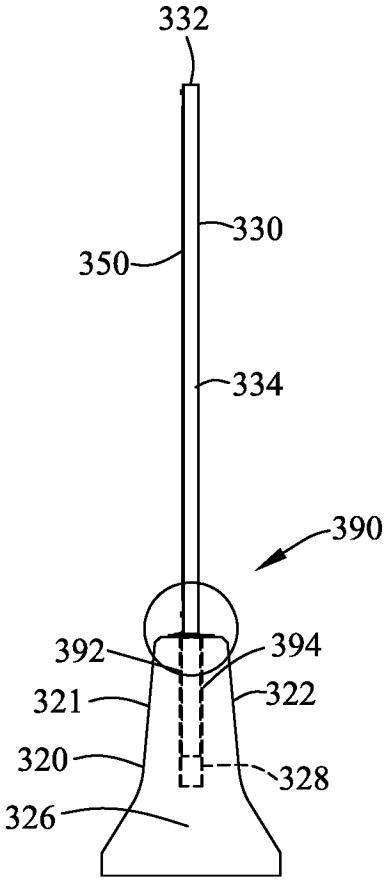
FIG. 38 is a right side view of FIG. 37.

FIGS. 27 and 28 are front and rear views of the interconnection of two of the portable acoustical road barriers 105A and 105B of FIG. 20 on adjacent road barriers 120A and 120B. The road barriers 120A and 120B are placed in an abutting or near abutting relationship. The right side overhang 166A of the sound blocking material 150A of the portable acoustical road barriers 105A is overlaid by the left side overhang 165B of the sound blocking material 150B of the portable acoustical road barriers 105B.

The first side hook fasteners 155A of the sound blocking material 150A of the portable acoustical road barriers 105A engages with the second side loop fasteners 156B the sound blocking material 150B of the portable acoustical road barriers 105B to secure the sound blocking material 150A to the sound blocking material 150B. The configuration of the hook and loop fasteners 155 and 156 located on opposed ends and oppose sides of the sound blocking material 150 permits multiple portable acoustical road barriers 105 to be extended in either the left or right direction in FIG. 27. This extension creates a continuous acoustical blocking materials web as road barriers 120 are placed in a conventional serial array.

FIGS. 29-34 illustrate a second embodiment of a portable acoustical road barrier 205 comprising an acoustical blocking panel 210 mounted on a road barrier 220. The portable acoustical road barrier 205 is similar to the portable acoustical road barrier 205 shown in FIGS. 20-26 with similar parts labeled with similar reference numeral raised by 100.

In this embodiment, the mount 290 comprises a first and a second mount 291 and 292 extending from the first and second ends of the panel frame 230 for removably securing the panel frame 230 to the road divider 220. The first and second mounts 291 and 292 comprise saddles having left and right legs 293 and 294 engaging with the left and right sides 221 and 222 of the road barrier 220. Preferably, the left and right legs 293 and 294 resiliently and frictionally engage with the left and right sides 221 and 222 of the panel frame 230 to secure the acoustical blocking panel 210 to the road barrier 220. Optional fasteners (not shown) may be used to secure the left and right legs 293 and 294 engaging with the left and right sides 221 and 222 of the road barrier 220.

FIGS. 35-40 illustrate a third embodiment of a portable acoustical road barrier 305 comprising an acoustical blocking panel 310 mounted on a road barrier 320. The portable acoustical road barrier 305 is similar to the portable acoustical road barrier 105 shown in FIGS. 20-26 with similar parts labeled with similar reference numeral raised by 200.

In this embodiment, the mount 390 comprises a first and a second mount 391 and 392 extending from the first and second ends 337 and 338 of the panel frame 330 for removably securing the panel frame 330 to the road divider 320. The first and second mounts 391 and 392 comprise extensions 393 and 394 of the left and right panel frame portions 313 and 314 extending into first and second apertures 327 and 328 in the upper surface 324 of the road divider 320.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A portable acoustic road barrier for use with a road divider, comprising:

a frame having a lower horizontal panel frame portion extending between a first and a second end;

a first and a second vertical panel frame portion;

a first and a second lower connector connecting said first and second ends of said lower horizontal panel frame portion to said first and second vertical panel frame portions;

an upper horizontal panel frame portion extending between a first and a second end;

a first and a second upper connector connecting said first and second vertical panel frame portions to said first and second ends of said upper horizontal panel frame portion;

said first and second vertical panel frame portion and said lower and upper horizontal panel frame portion being connected in proximity to the road divider;

a first mount extending from said first end of said frame for removably securing said frame to the road divider;

a second mount extending from said second end of said frame for removably securing said frame to the road divider;

a sheet of acoustical blocking material having a first and a second side and bound by a material edge;

said sheet of acoustical blocking material having a thickness of approximately one-eighth of an inch and a density of greater than one pound per square foot;

a plurality of fasteners securing said flexible acoustical blocking material to said panel frame portions; and said sheet of acoustical blocking material and said reinforcing tape being flexible for enabling said sheet of acoustical blocking material to be rolled as a single unit for transportation and securing to said frame after assembly thereof.

2. A portable acoustic road barrier as set forth in claim 1, wherein said first and second vertical panel frame portions are removably secured to said first and a second end of said frame; and said upper horizontal panel frame portion being removably secured to said first and second end of said first and second vertical panel frame portions.

3. A portable acoustic road barrier as set forth in claim 1, wherein said first mount includes a first flange secured to said first end of said frame for fastening to a first portion of the road divider; and said second mount including a second flange secured to said second end of said frame for fastening to a second portion of the road divider.

4. A portable acoustic road barrier as set forth in claim 1, wherein said first mount includes a first saddle secured to said first end of said frame for fastening to a first portion of the road divider; and said second mount including a second saddle secured to said second end of said frame for fastening to a second portion of the road divider.

5. A portable acoustic road barrier as set forth in claim 1, wherein said first mount includes said first vertical panel frame portions extending into a first aperture in the road divider; and Said second mount indulging said second vertical panel frame portions extending into a second aperture in the road divider.

6. A portable acoustic road barrier as set forth in claim 1, wherein said material edge of said sheet of acoustical blocking material includes a first through fourth edge defining a perimeter of said sheet of acoustical blocking material.

7. A portable acoustic road barrier as set forth in claim 1, wherein said sheet of acoustical blocking material comprises a sheet of flexible barium free formulation mineral filled to have a weight greater than one pound per square foot.

8. A portable acoustic road barrier as set forth in claim 1, wherein said reinforcing tape comprises a woven polyester material.

9. A portable acoustic road barrier as set forth in claim 1, including a flexible reinforcing tape permanently affixed to said first side of said sheet of acoustical blocking material adjacent to said material edge.

10. A portable acoustic road barrier as set forth in claim 1, including a flexible reinforcing tape permanently affixed to said first side of said sheet of acoustical blocking material adjacent to said material edge; and said reinforcing tape being heat welded to said acoustical blocking material.

11. A portable acoustic road barrier as set forth in claim 1, including a flexible reinforcing tape permanently affixed to said first side of said sheet of acoustical blocking material adjacent to said material edge; and each of said reinforcing tape and said first side of the sheet of acoustical blocking material are simultaneously heated to an appropriate temperature and said reinforcing tape is pressed upon said first side of said sheet of acoustical blocking material.

12. A portable acoustic road barrier as set forth in claim 1, including a flexible reinforcing tape permanently affixed to said first side of said sheet of acoustical blocking material adjacent to said material edge; and said sheet of acoustical blocking material and said reinforcing tape are flexible for enabling the entire acoustical blocking material including said sheet of acoustical blocking material and reinforcing tape to be rolled as a single unit for transportation.

13. A portable acoustic road barrier as set forth in claim 1, wherein said sheet of acoustical blocking material has a first and a second side and bound by material edge;

a flexible reinforcing tape permanently affixed to said sheet of acoustical blocking material adjacent to said material edge; and said plurality of fasteners extending through said reinforcing tape and said sheet of acoustical blocking material for securing said flexible acoustical blocking material to said panel frame portions for inhibiting the flow of acoustic energy between said first and second sides of the acoustical blocking material.

* * * * *